US008162675B2

(12) United States Patent
Regnier et al.

(10) Patent No.: US 8,162,675 B2
(45) Date of Patent: Apr. 24, 2012

(54) CONNECTOR SHIELD WITH INTEGRATED FASTENING ARRANGEMENT

(75) Inventors: Kent E. Regnier, Lombard, IL (US); Harold Keith Lang, Cary, IL (US); Patrick R. Casher, North Aurora, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/062,977

(22) PCT Filed: Sep. 9, 2009

(86) PCT No.: PCT/US2009/056300

§ 371 (c)(1),
(2), (4) Date: May 26, 2011

(87) PCT Pub. No.: WO2010/030620

PCT Pub. Date: Mar. 18, 2010

(65) Prior Publication Data

US 2011/0223805 A1 Sep. 15, 2011

Related U.S. Application Data

(60) Provisional application No. 61/095,450, filed on Sep. 9, 2008, provisional application No. 61/110,748, filed on Nov. 3, 2008, provisional application No. 61/117,470, filed on Nov. 24, 2008, provisional application No. 61/153,579, filed on Feb. 18, 2009, provisional application No. 61/170,956, filed on Apr. 20, 2009, provisional application No. 61/171,066, filed on Apr. 20, 2009, provisional application No. 61/171,037, filed on Apr. 20, 2009.

(51) Int. Cl.
*H01R 12/00* (2006.01)

(52) U.S. Cl. ..... 439/76.1

(58) Field of Classification Search ..... 439/76.1, 439/676, 607.4, 607.13
See application file for complete search history.

(56) References Cited

U.S. PATENT DOCUMENTS

| | | | | |
|---|---|---|---|---|
| 5,249,983 | A * | 10/1993 | Hirai | 439/573 |
| 6,019,632 | A * | 2/2000 | Ozai et al. | 439/550 |
| 6,193,553 | B1 * | 2/2001 | Yu | 439/607.36 |
| 6,234,837 | B1 | 5/2001 | Wu | |
| 6,364,709 | B1 | 4/2002 | Jones | |
| 6,612,868 | B2 | 9/2003 | Hwang | |
| 6,666,720 | B1 | 12/2003 | Reisinger | |
| 6,733,339 | B2 | 5/2004 | Casey | |
| 7,070,446 | B2 | 7/2006 | Henry et al. | |
| 2005/0255726 | A1 | 11/2005 | Long | |
| 2006/0003632 | A1 | 1/2006 | Long | |
| 2006/0189180 | A1 * | 8/2006 | Lang et al. | 439/76.1 |
| 2006/0216969 | A1 | 9/2006 | Bright et al. | |
| 2011/0300757 | A1 * | 12/2011 | Regnier et al. | 439/626 |

OTHER PUBLICATIONS

International Search Report for PCT/US2009/056300.

* cited by examiner

*Primary Examiner* — Tulsidas C Patel
*Assistant Examiner* — Phuongchi Nguyen
(74) *Attorney, Agent, or Firm* — Stephen L. Sheldon

(57) ABSTRACT

A shield for a connector that can provide a card-receiving slot is disclosed. The shield includes sides that provide an enclosure. The shield includes a fastener that is held in place by a retaining notch in a bottom of the shield. The retaining notch is configured to support the fastener in place and restrain it from unintended translation or rotation.

4 Claims, 21 Drawing Sheets

CONNECTOR SHIELD WITH INTEGRATED FASTENING ARRANGEMENT

REFERENCE TO RELATED APPLICATIONS

This application is a national phase of international application PCT/US09/56300, filed Sep. 9, 2009 and claims priority to U.S. Provisional Appln. No. 61/095,450, filed Sep. 9, 2008; to Appln. No. 61/110,748, filed Nov. 3, 2008; to Appln. No. 61/117,470, filed Nov. 24, 2008; to Appln. No. 61/153,579, filed Feb. 18, 2009, to Appln. No. 61/170,956 filed Apr. 20, 2009, to Appln. No. 61/171,037, filed Apr. 20, 2009 and to Appln. No. 61/171,066, filed Apr. 20, 2009, all of which are incorporated herein by reference in their entirety.

BACKGROUND OF THE INVENTION

The present invention generally relates to connectors suitable for transmitting data, more specifically to input/output (I/O) connectors and exterior shielding cages or compartments therefore which are fastened to a circuit board.

One aspect that has been relatively constant in recent communication development is a desire to increase performance. Similarly, there has been constant desire to make things more compact (e.g., to increase density). For I/O connectors using in data communication, these desires create somewhat of a problem. Using higher frequencies (which are helpful to increase data rates) requires good electrical separation between signal terminals in a connector (so as to minimize cross-talk, for example). Making the connector smaller (e.g., making the terminal arrangement more dense), however, brings the terminals closer together and tends to decrease the electrical separation, which may lead to signal degradation.

One additional issue is that for higher density solutions, there is still a need to securely mate plug connectors to cables. Because of the need to control EMI, plugs are often sized to snuggly fit inside a port. This tends to increase insertion forces, which are also affected by the use of dual-slot connectors. To resist such forces, connector assemblies can be secured to a circuit board by soldering. This soldering is effected at vias, or holes in the circuit board into which compliant pin tail portions are pressed. The soldering has issues, however, as it does not provide the best joint for resisting possible shear forces or forces that generate bending moments to the shielded connector assembly. It is difficult to use prior methods of fastening (e.g., bolts and screws) on new, more compact connector assemblies in a dense connector assembly. Accordingly, certain people would appreciate an improved system for fastening a shield/connector assembly to a circuit board

SUMMARY OF THE INVENTION

A shield is provided that defines an enclosure that can support a housing with a card-receiving slot. The cages are stamped and formed from sheet metal and are assembled from multiple pieces to form a hollow enclosure. Typically, they will include a separate cover, two side walls and a baseplate. The baseplate extends longitudinally within the connector and defines a floor of the interior hollow portion of the connector. The baseplate is includes a restraining notch configured to support a fastener. The restraining notch can include stop surfaces and engagement arms to secure and restrain the fastener. The fastener can be a nut or a screw and one of the engagement arms can be split so as to engage the fastener on two opposing sides.

BRIEF DESCRIPTION OF THE DRAWINGS

Throughout the course of the following detailed description, reference will be made to the drawings in which like reference numbers identify like parts and in which.

DETAILED DESCRIPTION OF THE ILLUSTRATED EMBODIMENTS

As required, detailed embodiments are disclosed herein; however, it is to be understood that the disclosed embodiments are merely exemplary and may be embodied in various forms. Therefore, specific details disclosed herein are not to be interpreted as limiting, but merely as a basis for the claims and as a representative basis for teaching one skilled in the art to variously employ the disclosure in virtually any appropriate manner, including employing various features disclosed herein in combinations that might not be explicitly disclosed herein.

Figure 1:
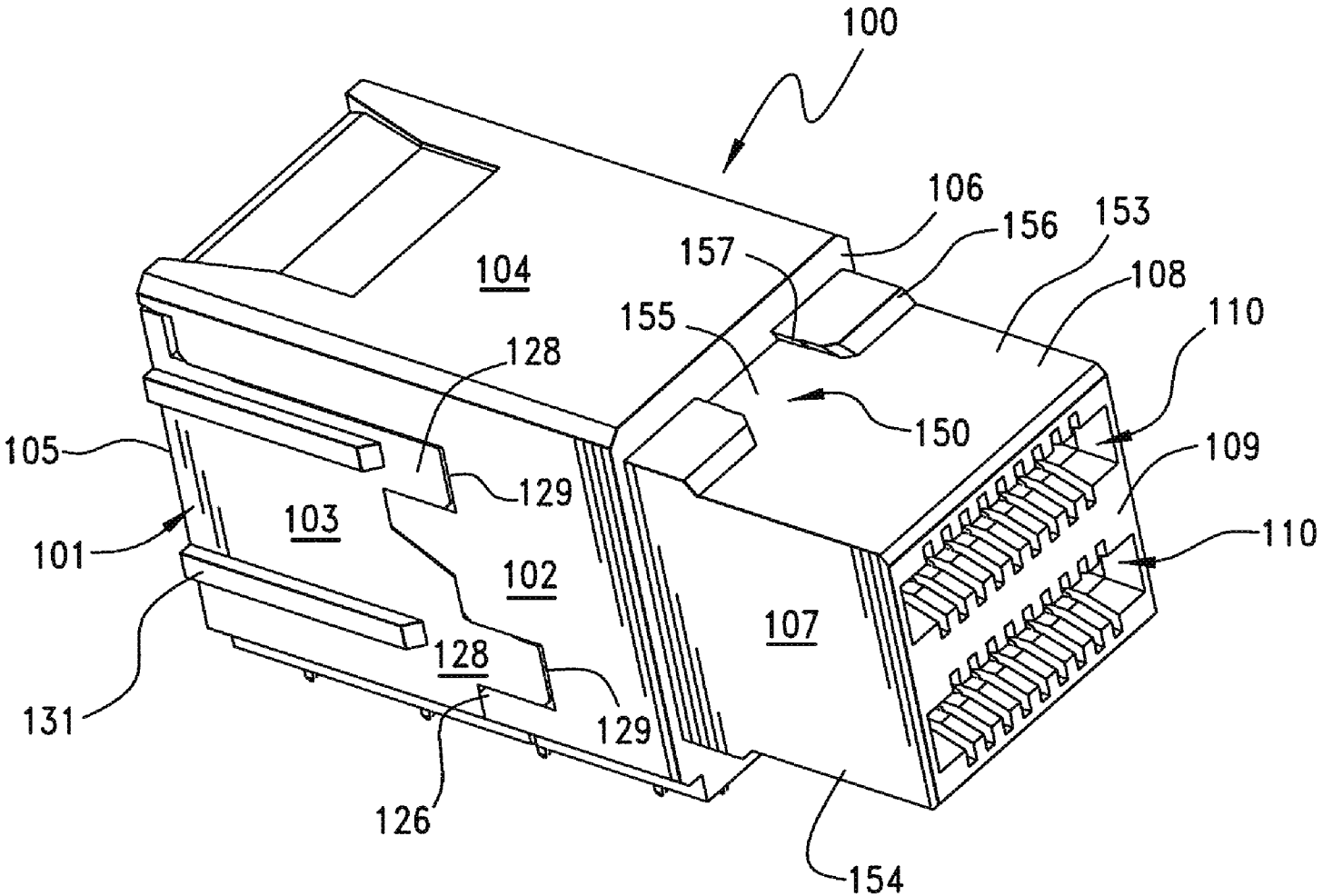
FIG. 1 illustrates a perspective view of an embodiment of connector that can be combined with a shield.

FIG. 1 illustrates a connector 100 that is utilized in the shielded housings of the present invention. The connector 100 takes the form of an insulative housing 101 which is illustrated as having two interengaging first and second (or front and rear) pieces, or parts 102, 103. The housing 101, as shown in FIG. 1 has a wide body portion 104 that extends between a rear face 105 and the front face 106. A mating portion 107 that takes the form of an elongated nose portion 108 projects forwardly of the front face 106 and terminates in a mating face 109. The mating face 109 may have one or more circuit card-receiving slots 110 that are formed widthwise in the mating face 109, with two such slots 110 being shown in FIG. 1. In an embodiment, the slots 110 can be about 4 mm apart (in a vertical direction) so as to provide a compact connector design. As the depicted connector is suitable for high data rates such as 6 Gbps or 10 Gbps (e.g., signal frequencies of greater than 4.5 or 7.5 GHz) with conventionally acceptable electrical properties of 3 percent or less crosstalk in a worse case scenario (e.g., not more than 3 percent cross talk between any two differential signal pairs), the depicted housing can provide a noticeable improvement in density and performance compared to existing connector designs. When this is taken in conjunction with a possible overall small size of the connector, a substantially improved connector is possible. In an embodiment, for example, a shield can be provided such that an opening in the shield to receive an opposing connector is less than 3 times as tall or wide as the separation distance in conjunction with a connector that has two slots that are separated by 4 mm and provides less than three (3) percent crosstalk at a 7.5 GHz signal frequency and more preferably less than two (2) percent crosstalk.

Figure 2:
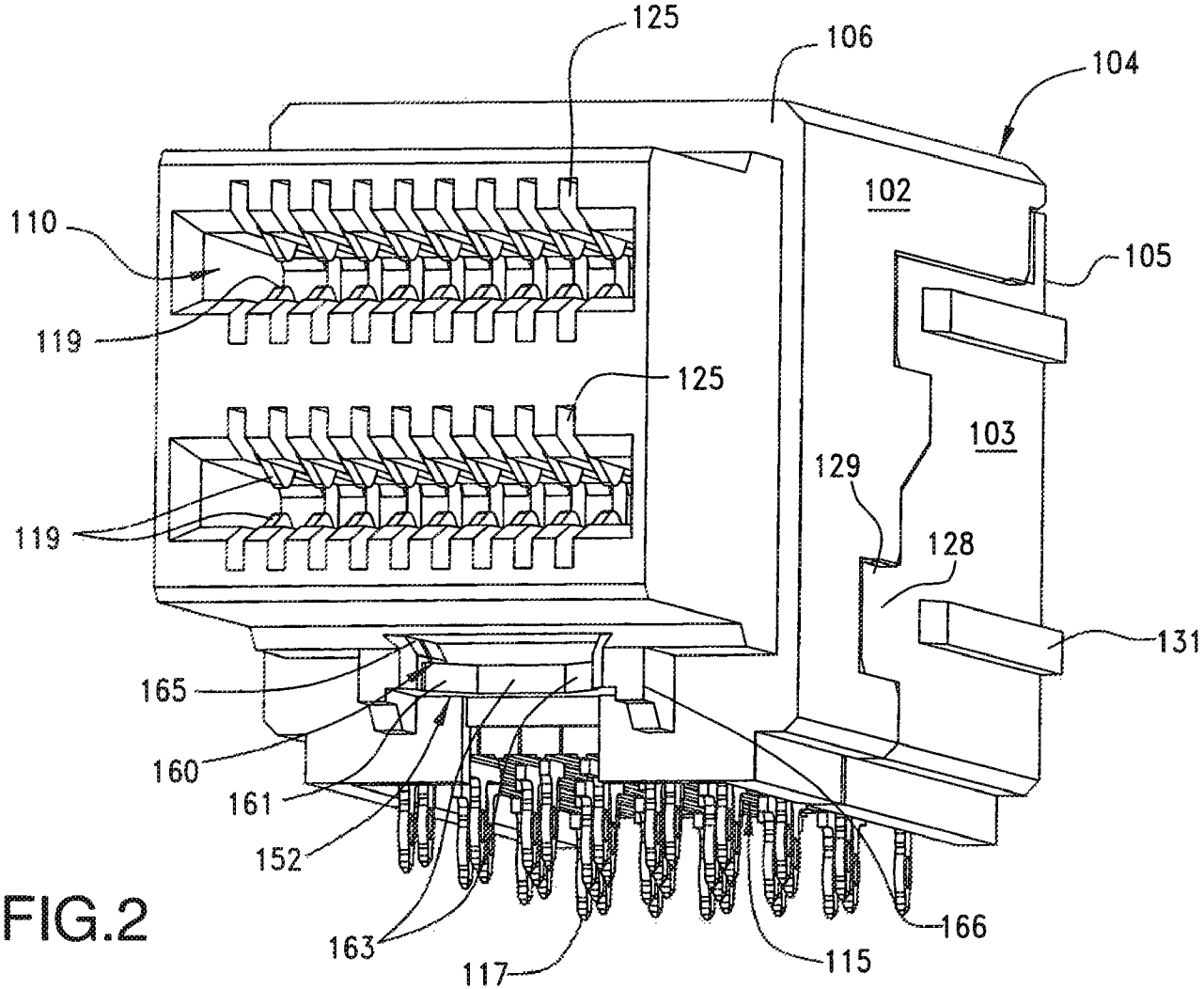
FIG. 2 illustrates a frontal perspective view of the connector of FIG. 1.
Figure 3:
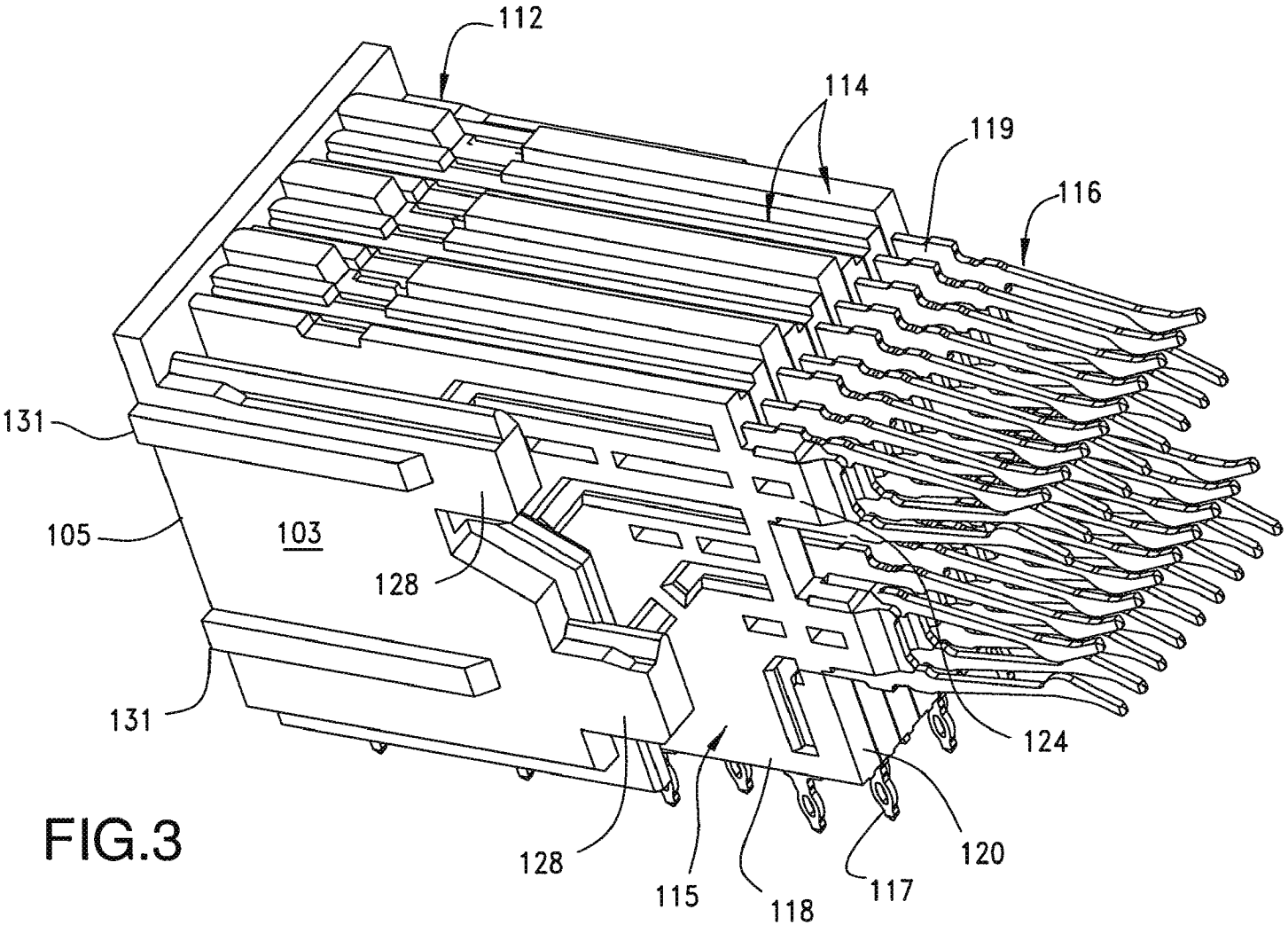
FIG. 3 illustrates a perspective view of the connector of FIG. 1 laying on its side with one of the housing portions removed to illustrate the terminal assemblies housed in the connector.
Figure 4:
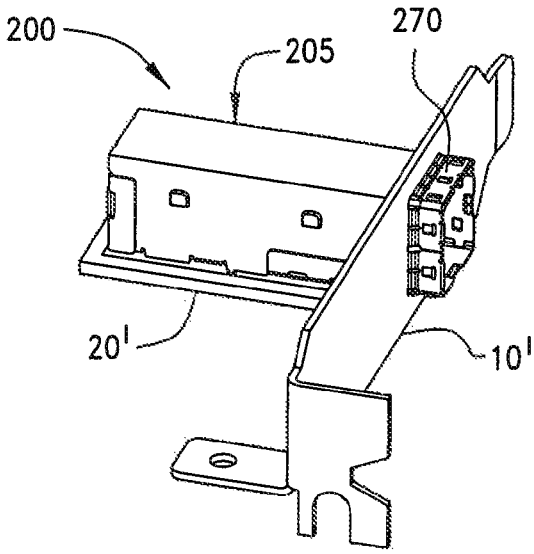
FIG. 4 illustrates a perspective view of an embodiment of a connector assembly mounted to a bracket.
Figure 5:
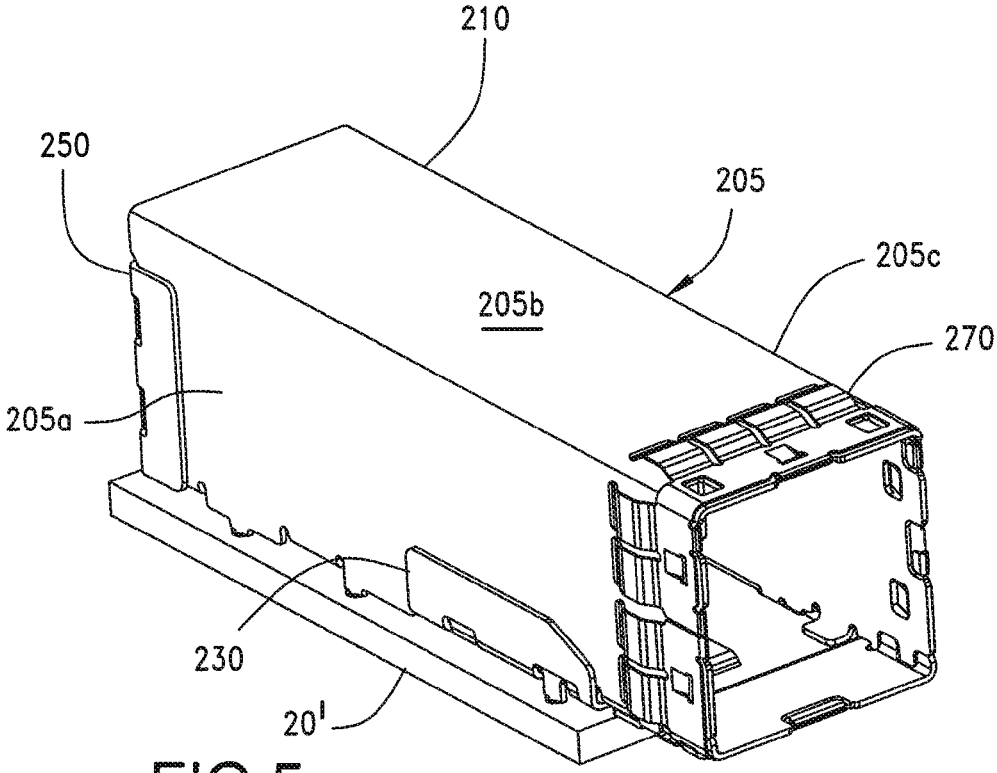
FIG. 5 illustrates a perspective view of an embodiment of a connector assembly mounted to a circuit board.

As shown in FIGS. 2-3, the housing 101 has a hollow interior portion 112 that receives a plurality of terminal assemblies 114 that take the form of insulative frames, or wafers, 115. Each such frame 115 contains a plurality of conductive terminals 116 having tail portions 117 projecting out from one edge 118 and contact portions 119 projecting from a second edge 120 of the frame 115. In the illustrated embodiment, the two edges 118, 120 are adjacent each other. The terminals 116 further include body portions 121 that interconnect the tail and contact portions 117, 119 together. The terminal assembly frames 115 may have openings 123 formed therein in the form of slots that extend along the terminal body portions 121 to expose them to air and thereby affect the terminal impedance.

The terminal assemblies are held together as a block within the housing 101 in a manner such that the terminal tail portions 117 extend out through the bottom of the housing 101 to define a mounting face of the connector 100 and the terminal contact portions 119 extend from the edges 120 of their frames 115 into the housing nose portion 108. The terminal contact portions 119 are arranged in the frames 115 as pairs of terminals, preferably for differential signal transmission, and each pair is contained within and on opposite sides of one of the card-receiving slots 110.

The terminals 116 as noted above, project forwardly from the leading edge 120 of the terminal assembly frames 115, and portions 124 of the frames 115 extend past the leading edge 120. As can be understood from the drawings, the terminal contact portions 119 are cantilevered in their structure and act as contact beams that deflect away from the slots 110 when a circuit card is inserted therein. In order to accommodate this upward and downward deflection of the terminal contact portions 119, the nose portion 108 of the housing 101 has terminal-receiving cavities 125 (FIGS. 1 & 2) that extend vertically, a preselected distance, above and below centerlines of each slot 110.

Returning to FIGS. 1 and 3, the housing 101 has two pieces or halves 102, 103 which mate along an irregular mating line 126 that extends upwardly through the sides of the housing 101 along a path that extends from the front to the rear of the housing 101. With this irregular configuration, a pair of rails 128 and channels 129 are defined in the two housing pieces 102, 103 with the rails 128 fitting into the channels 129. Outer ribs 131 may also be formed on the exterior side surfaces of the rear housing part 103 and these ribs 131 are preferably horizontally aligned with the rails 128 to provide reinforcement to the rails 128, but also to provide a means for positioning the connector subassembly 100 in an exterior shielded housing, or shroud.

As shown best in FIG. 2, the housing 101 may include retaining groove for holding, or engaging a fastener, such as a nut. This retaining groove 152 is shown disposed on the bottom of the housing 101, underneath the mating portion 107, and particularly the elongated nose portion 108 and proximate to the mounting face of the connector. The retaining groove 152 comprises a multi-faceted recess 160 that is formed in a base portion of the housing and spaced rearwardly of the opening of the shielded housing. The depicted multi-faceted recess includes a plurality of flat surfaces 163 that are disposed adjacent each other and which define facets of the multi-faceted recess 160. In an embodiment, the flat surfaces 163 can provide a hexagonal or octagonal configuration. As will be developed to follow, this recess 160 and its flat surface 165 may be utilized to engage a fastener, such as a nut or screw. These surfaces assist in aligning the housing 101 with a fastener 290.

FIGS. 4-9 illustrate an embodiment of a port 200 which can be used to house the connector 100 and provide EMI shielding thereto. The port 200 includes an enclosure with a hollow interior that substantially encloses the connector 100 except for its mounting face from which the terminal tail portions 117 of the connector 100.

The port 200 includes a shield 205 that is depicted mounted to an opening in faceplate 10' and the port 200 includes an EMI gasket collar 270 that encircles the shield 205 and engages the faceplate 10'. The shield 205 (FIG. 5) that is defined by a plurality of sides, such as a first side 205*a*, a second side 205*b* and a third side 205*c*. These sides 205*a-c* and a baseplate 230 and a rear plate 250 cooperatively define the enclosure that receives the connector assembly 100 therein.

Figure 6:
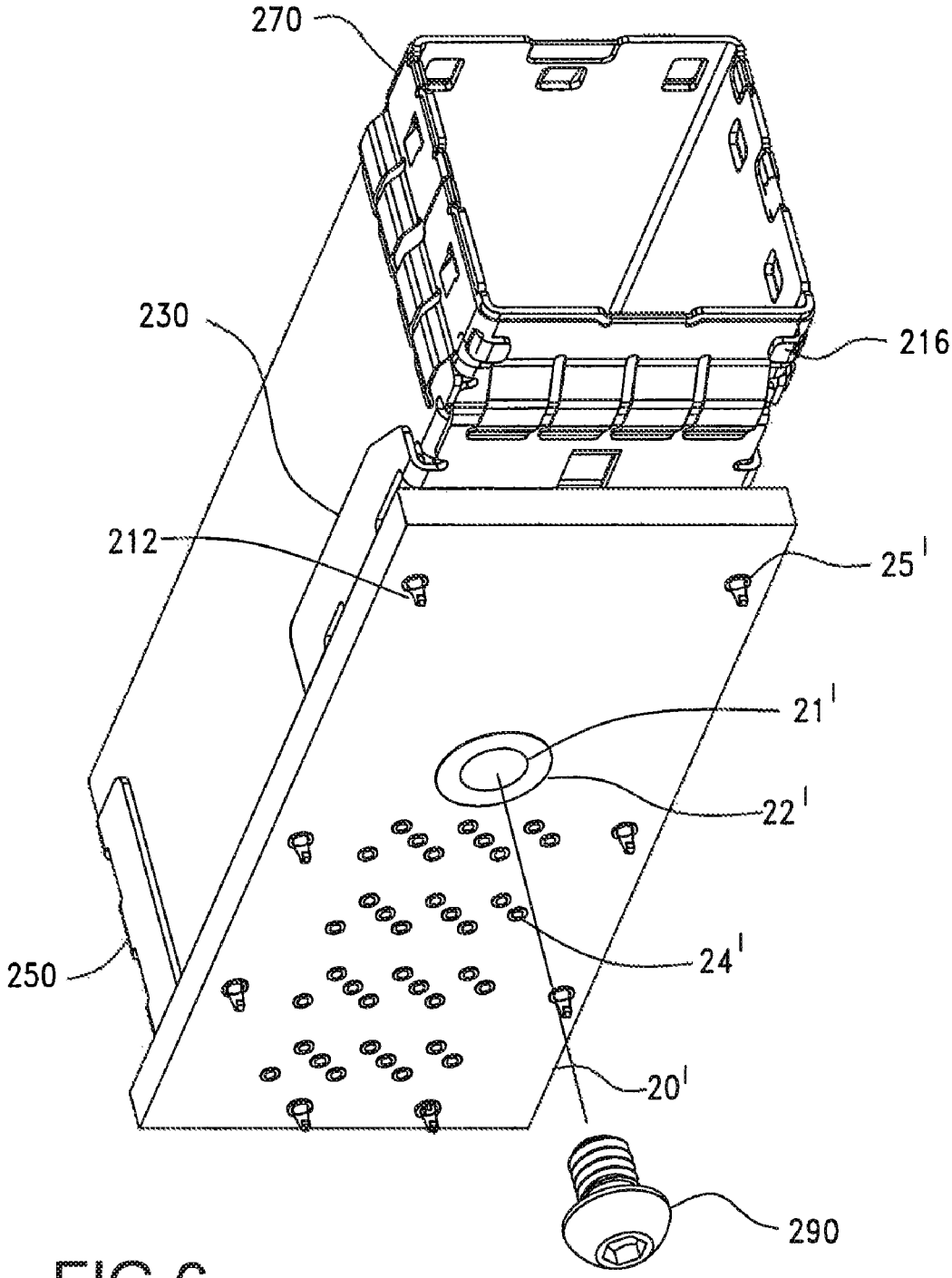
FIG. 6 is an perspective the same view as FIG. 5, but taken from the underside thereof.

The shield 205 engages the circuit board 20' and is coupled thereto. As shown in FIG. 6, the assembly may include a fastener 290 (depicted for purposes of clarity as a threaded nut but not so limited) that is supported by the shield 205 and provides a mechanism by which the shield 205 may be fastened to the circuit board 20'. As can be appreciated, a screw 300 can be inserted through an aperture 21' in the circuit board 20', which may include force spreader 22', also in the circuit board so as to engage the threaded member 290 and secure the connector 100 to the board, thus providing additional structural rigidity to the mounted assembly as compared to merely using tails 212, 252 formed integrally with and extending from the shield 205 that engage and which are soldered to the PCB. As can be further appreciated, the fastener could also have a conventional screw-like configuration that extends through the circuit board when the two are joined and engages a fastener nut.

Figure 7:
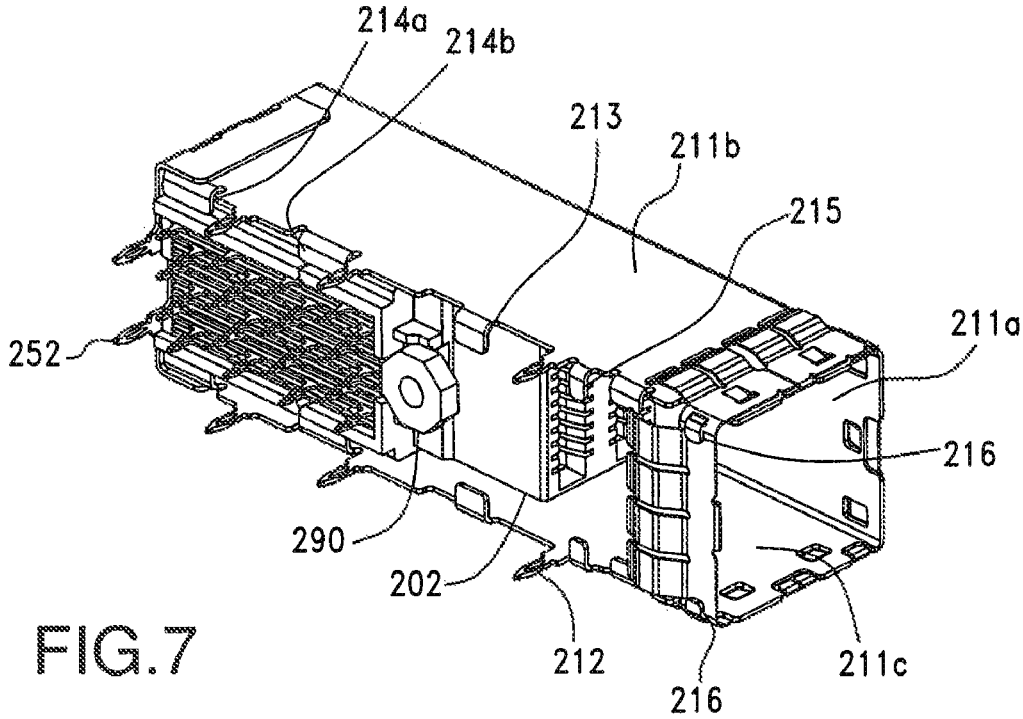
FIG. 7 illustrates a perspective view of the assembly depicted in FIG. 6, but with the circuit board and baseplate removed for clarity to illustrate the internal connector assembly and fastener.
Figure 8:
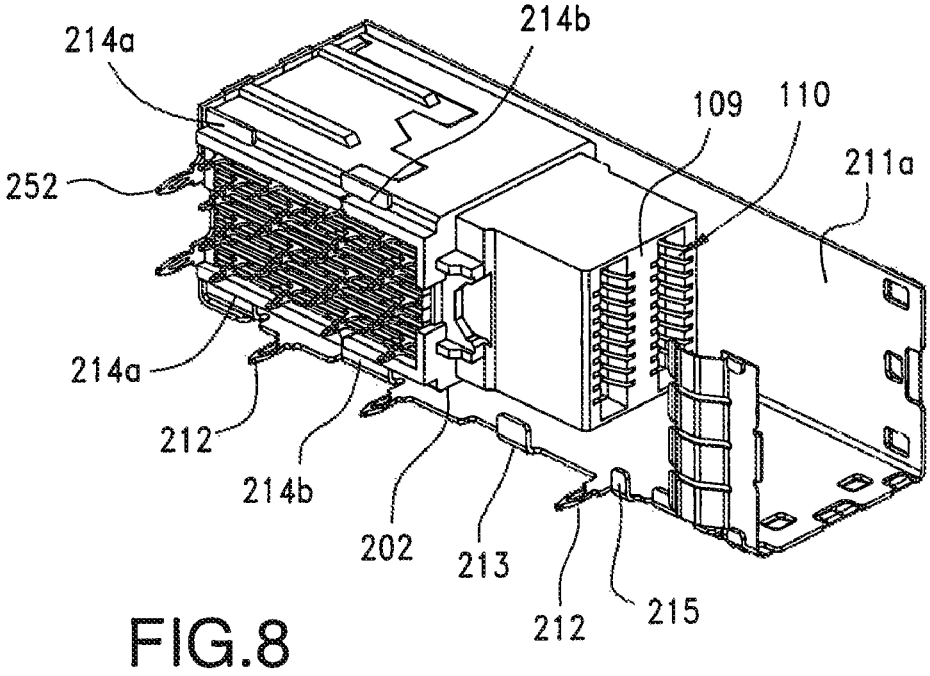
FIG. 8 illustrates the same view as FIG. 7, but with a sidewall of the shield and the fastener removed for clarity.
Figure 9:
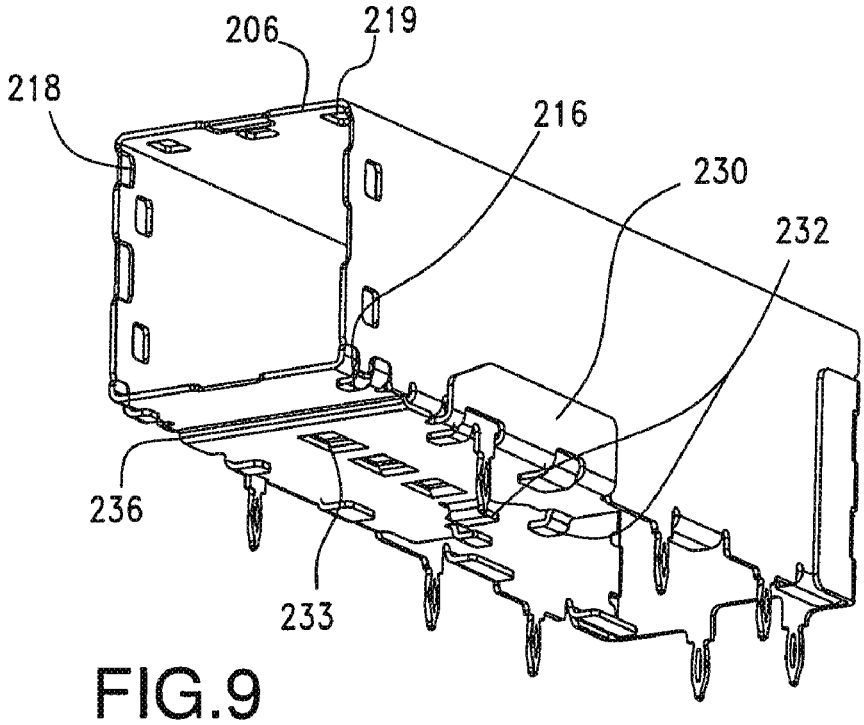
FIG. 9 illustrates a perspective view of the shield depicted FIG. 5, taken from below and with the EMI gasket removed.

As depicted in FIG. 9, the shield 205 may be assembled from three distinct parts, a cover 210, the baseplate 230 and the rear plate 250 that are coupled together by way of a series of engagement tabs. Such a construction allows the portions of the shield 205 to be assembled in a desired order. For example, the cover 210 may be formed in its inverted U-shape, as shown, and the connector assembly 100 may be inserted into the partial housing, with the connector assembly being engaged by connector assembly tabs 214*a*, 214*b* (FIGS. 7 & 8). Then, the baseplate 230 may be assembled and coupled to it via engagement tabs 213, 215, and then the rear plate 250 may be assembled to the two other housing portions, also with bent tabs 220 so as to form a combined connector assembly that then may be mounted on a circuit board (FIG. 9).

In an embodiment, the cover 210 can be formed as a single unit and include a plurality of engagement tabs, 213 and 215, that are formed along bottom edges thereof. These tabs 213, 215 are positioned to engage the baseplate 230 to secure the cover 210 and baseplate 230 together. The baseplate 230 further is held between the lower tabs 213, 215 of the shield and front engagement tabs 226 so as to securely couple the cover 210 and baseplate 230 together. As depicted, the baseplate 230 also includes a pair of side panels 230*b* that are bent upwardly out of the plane of the baseplate and adjacent the sidewalls of the cover 210.

Figure 10A:
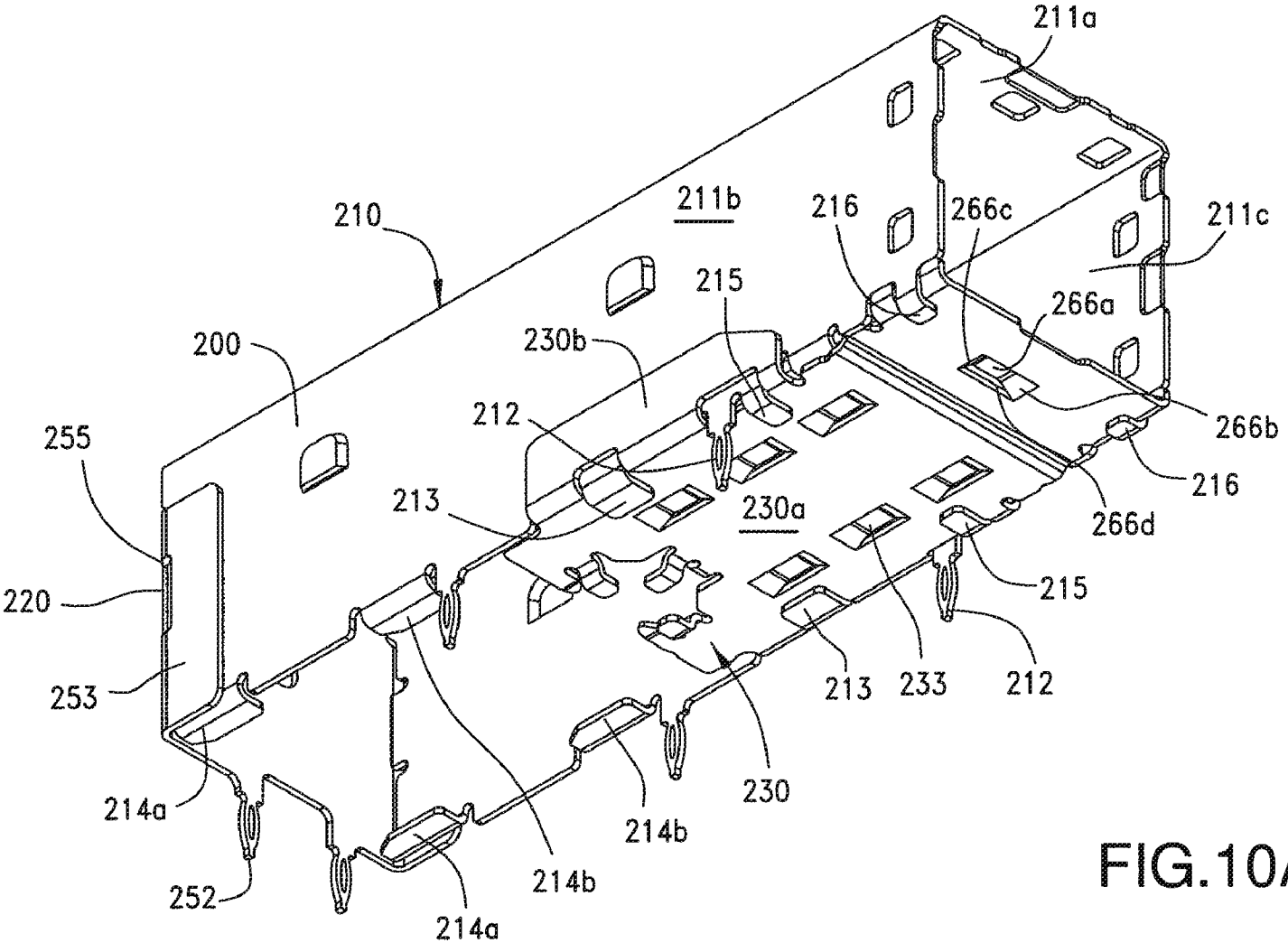
FIG. 10A illustrates a perspective view of an embodiment of a shield.
Figure 10B:
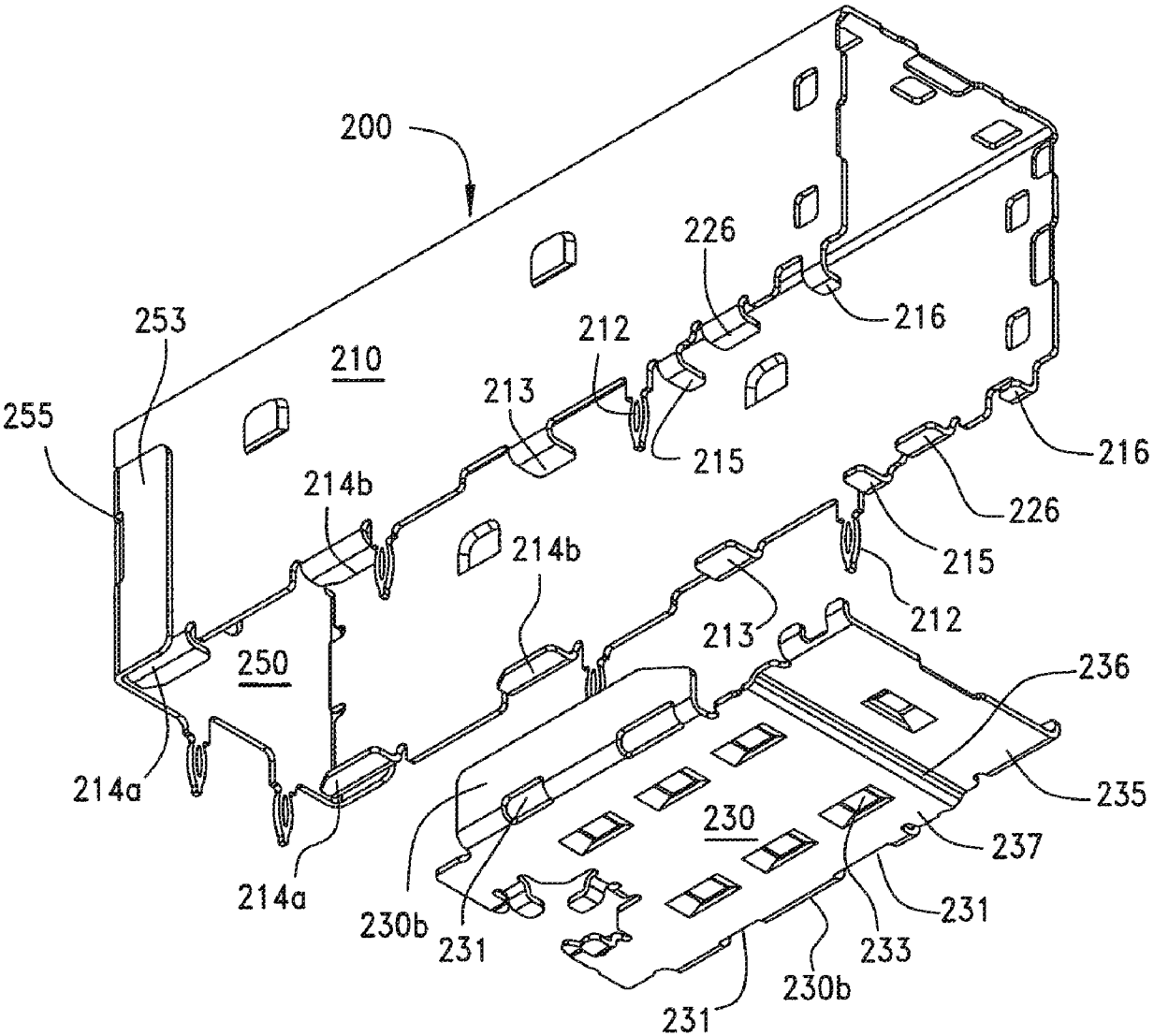
FIG. 10B illustrates a partially exploded view of the embodiment depicted in FIG. 10A.
Figure 10C:
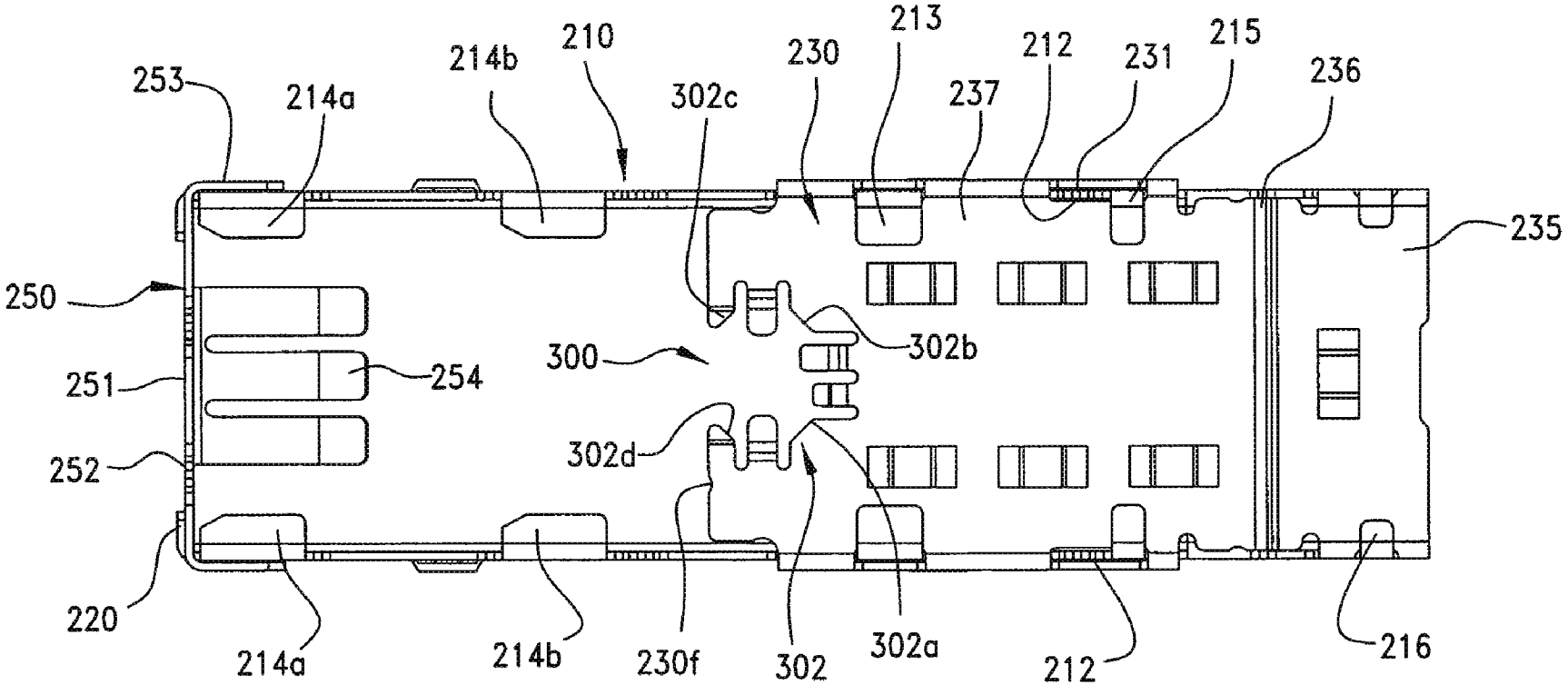
FIG. 10C illustrates a bottom plan view of the shield depicted in FIG. 10A.

This manner of engagement is shown best in FIGS. 10A-10C where it can be seen that the baseplate 230 also has a general U-shape when its side panels 230*b* are bent upwardly. These side panels 230*b* have slots 231 disposed therein that are aligned with the engagement tabs 213, 215 of the upper housing 210. The front support tabs 226 of the cover 210 provide a measure of support for the baseplate 230 and engage it by contacting confronting portions of the inner surfaces of the baseplate, while the first housing engagement tabs 213, 215 extend through the slots 231 and are bent over the baseplate 230 so that they bear against the bottom surfaces thereof. The front most slot 231 is preferably of a longer width than the rearmost slot so as to accommodate, as illustrated more clearly in FIGS. 10A-C, the combined engagement tab-tail combination 215-212 as described in more detail below. The cover 210 also includes gasket retaining tabs 216 disposed at the front end and of the upper housing. As shown in Figures, especially FIGS. 7 & 10C, these tabs 216 extend through slots on the lower half of the gasket collar 270 and are bent thereupon to retain it in place at the front of the housing. The combination of these engagement tabs and the side panels allows the cover and baseplate to be held together in a secure manner.

Similar features may be used to secure the rear plate 250 to the cover 210. The depicted rear plate 250 includes a rear wall 251 and two side panels 253 that extend outwardly and are bent out of plane from the rear wall 251. The side panels 253 have slots 255 formed thereon in alignment with the rear edges of the housing sidewalls 205*b*, 205*c*. The shield 205 has a series of engagement tabs 220 that are formed along the rear edges and these tabs 220 are received in and extend through the slots 255 and then are bent over, adjacent to the rear wall 251. The rear plate 250 may also include a support tab 254 that is wider than the tabs 220 which is placed into contact against the inner surface of the housing top wall 205*a*. (FIG. 10C.) The cover 210 further includes tails 212 that are configured to engage apertures in a circuit board so as to electrically couple the shield 205 to ground circuits on the circuit board. The baseplate 230, in turn, securely holds the fastener 290 in place to prevent the fastener 290 from moving when the connector 100 is assembled into the port 200 and the port is attached to a circuit board and it serves to retrain the fastener 290 from rotating when a mating fastener is coupled to it.

It should be noted, however, that while the depicted construction provides certain advantages, they are not required and this disclosure is not intended to be limiting in this respect unless otherwise noted. Thus, any desirable shield construction configuration may be used.

As can be appreciated, at the forward end of the baseplate 230 a first bottom wall 235 and a second bottom wall 237 are provided which are joined together by an interconnecting shoulder 236. The first and second bottom wall 235, 237 are offset, with the first bottom wall 235 configured to be spaced away from the supporting circuit board, while the second wall 237 is positioned closer to the supporting circuit board. This construction, while not required, allows the resultant housing opening 206 to be positioned slightly above a supporting circuit board and can improve ease of assembly of a corresponding plug connector. The front bottom wall 235 has a front edge that aligns with the front edges of the shield 205 and completes the perimeter of the housing opening 206. A series of guides 233 may be formed in the baseplate and extend up from the second wall 237 portion of the baseplate. The top surfaces of these guides and can be aligned with the plane formed by first wall 235 so as to provide additional support for a plug connector as it is inserted into the housing, or they can extend further upwardly in the enclosure.

In the embodiment of FIGS. 4-9, the shield 205 has retaining notch 2310 formed therewith. As depicted, the retaining notch 2310 includes a plurality of stop surfaces 2390 that are formed in the baseplate 230 in a predetermined pattern, preferably to engage a multi-faceted feature 2330 of a fastener (not shown), the perimeter of which is defined at least in part by the stop surfaces 2390.

Figure 9A:
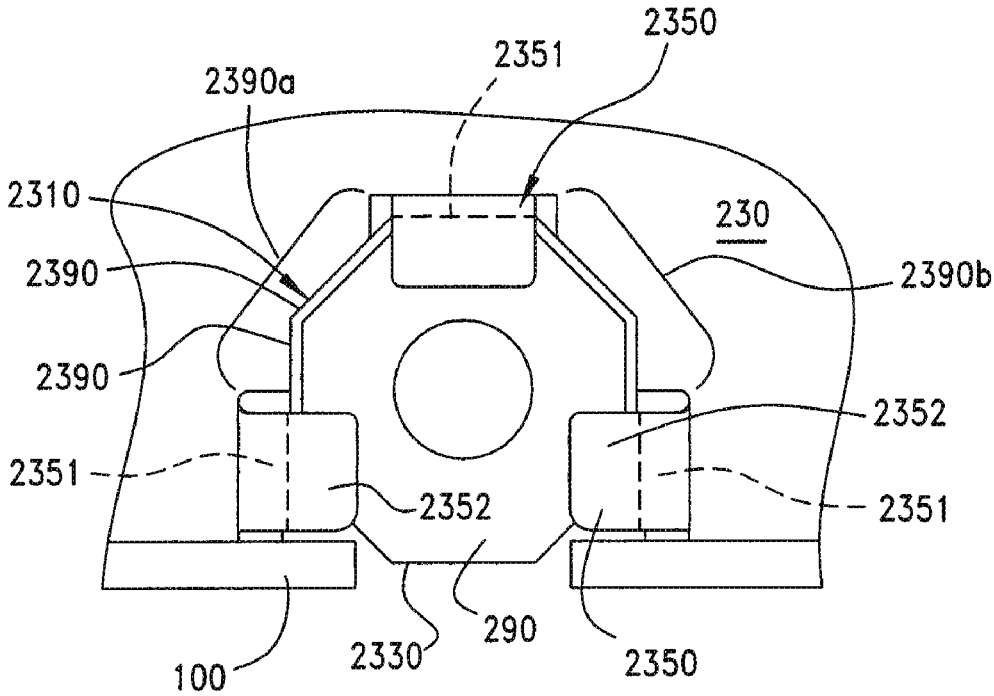
FIG. 9A illustrates a bottom plan detail view of an embodiment of a shield supporting a fastener.
Figure 22:
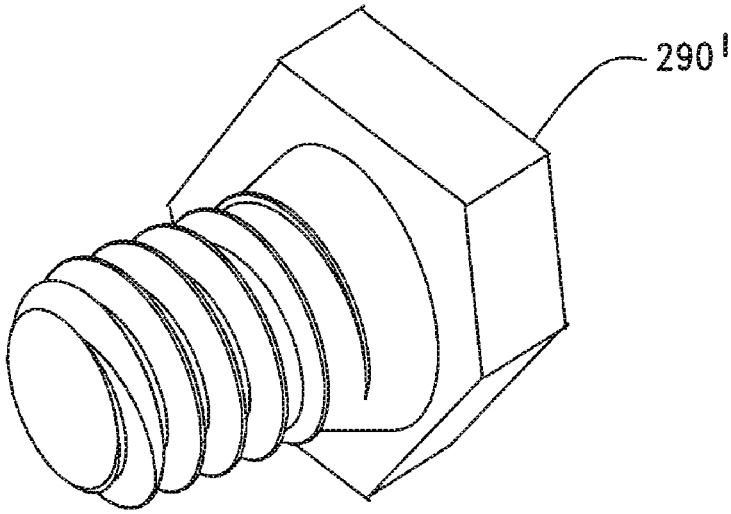
FIG. 22 illustrates a perspective view of an alternative embodiment of a fastener.

As depicted in FIG. 9A, the retaining notch 2310 includes pairs of the stop surfaces 2390 disposed adjacent each other to provide a recess or nest that receives the fastener 290 therein. In an embodiment, the fastener 290 can have a threaded nut or a threaded cap, each of which has a plurality of distinct exterior surfaces that are angularly disposed with regard to each other and which are contiguous, or adjacent, each other. Such a fastener may have a hexagonal or octagonal configuration with multiple flat surfaces and it can be a nut or a screw, such as is shown in FIG. 22.

As depicted, not only are the stop surfaces 2390 of the retaining notch 2310 present, but also a plurality of engagement arms 2350 are provided, with three such arms 2350 being illustrated in FIG. 9A. These arms 2350 can be stamped and formed from the baseplate 230 and are bent out of the plane of the baseplate 230. In other words, in the embodiment illustrated, the engagement arms 2350 extend downwardly from the second bottom wall 237. Whereas the stop surfaces 2390 prevent unintended horizontal translation of the fastener 290, the engagement arms 2350 prevent unintended vertical movement. To provide this support, the depicted engagement arms 2350 have a first leg 2351 that extends away form the baseplate 230 in a first (e.g., vertical) direction and a second leg 2352 that extends away from the first leg 2351 in a second (e.g, horizontal) direction.

The engagement arms 2350 may be closely spaced apart from each other and have a spacing equivalent to, or preferably slightly less than the spacing between the ends (flats) of the fastener 290 so as to grip the fastener in place against the stop surfaces. As depicted in FIGS. 4-9, the stop surfaces 2390 have adjacent, or contiguous pairs 2390*a*, 2390*b* and each of these pairs are separated from each other by an intervening space occupied by an engagement arm.

Figure 13:
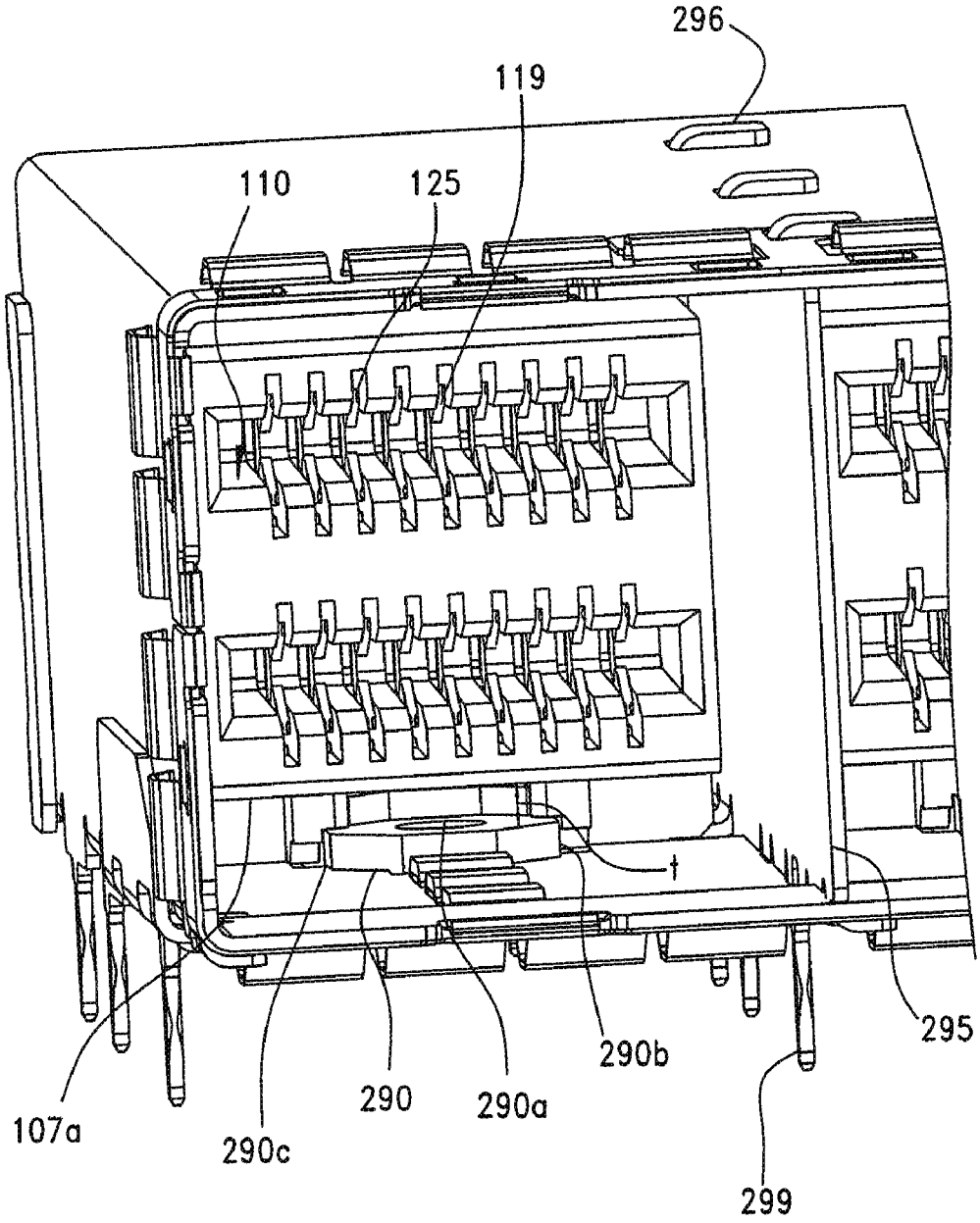
FIG. 13 illustrates an enlarged detail view of the interior of a port of the assembly depicted in FIG. 12.

As illustrated in FIG. 13, a space may be provided between the fastener 290 and an underside 107*a* of the housing 101, which may be a given height t (as shown in FIG. 13). This allows a portion of a mating plug connector (not shown) to be inserted therebetween while a portion of the housing 101 engages the fastener 290.

Figure 12:
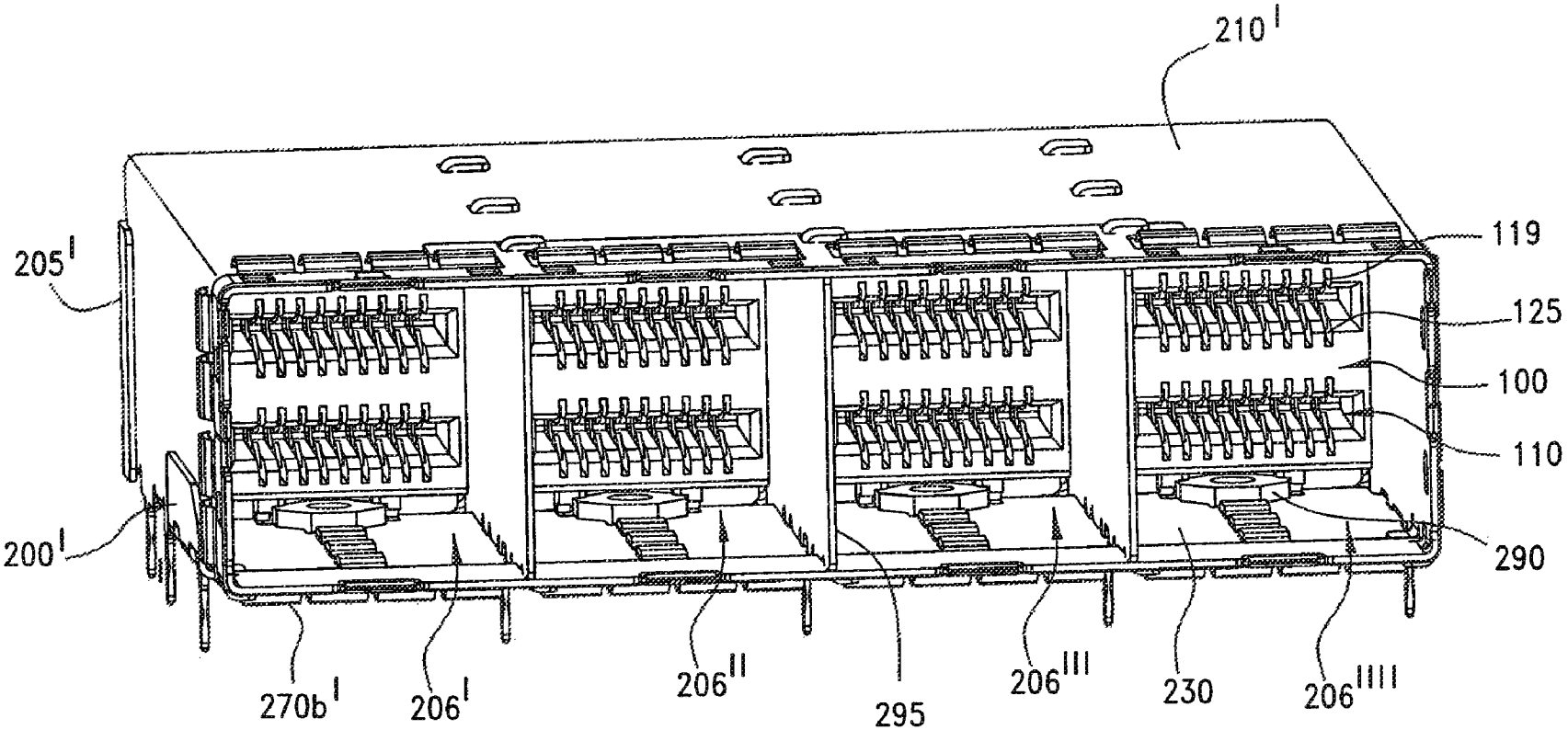
FIG. 12 illustrates a front perspective view of a ganged connector assembly.
Figure 14:
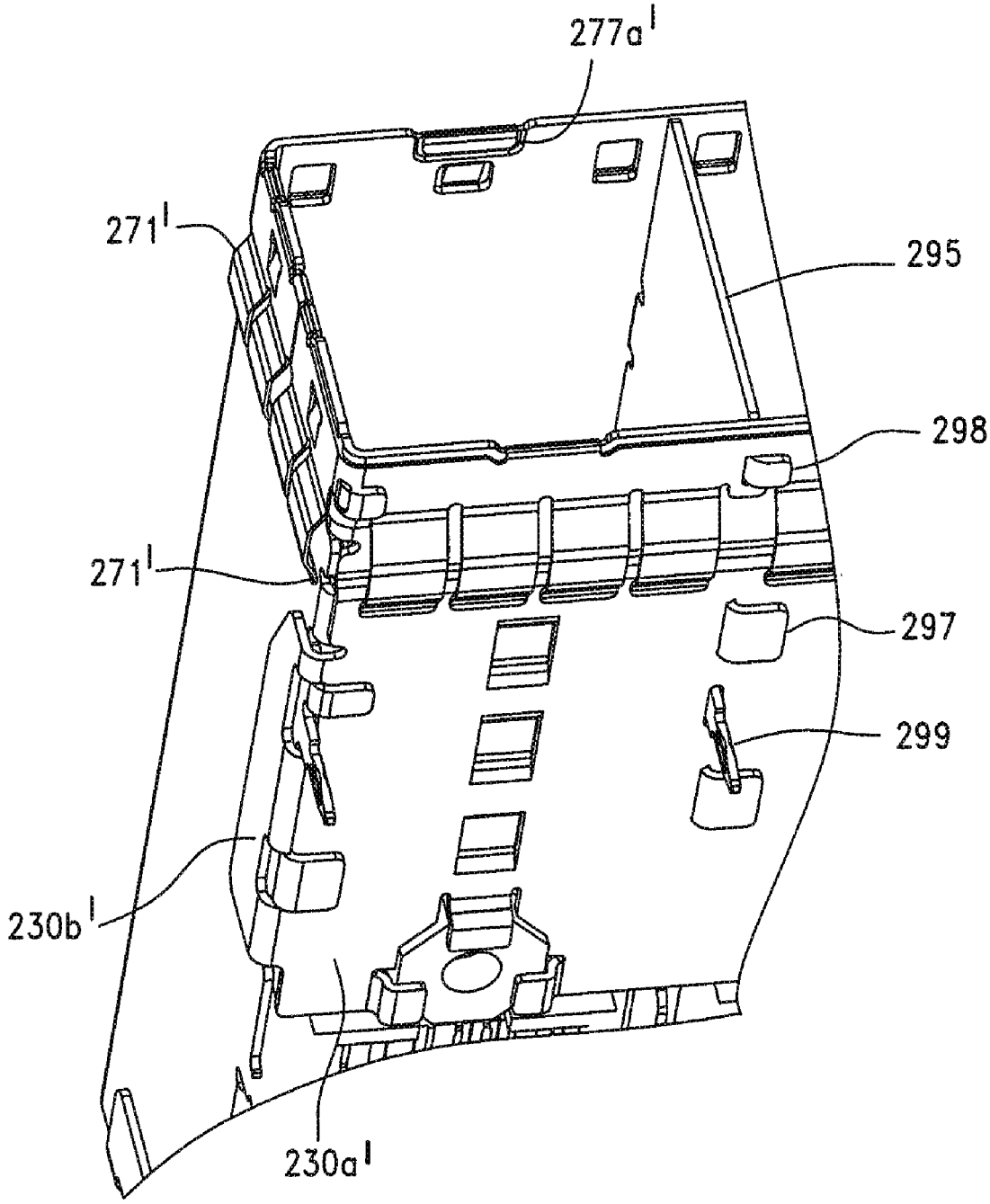
FIG. 14 illustrates another perspective view of the detail depicted in FIG. 13.
Figure 15:
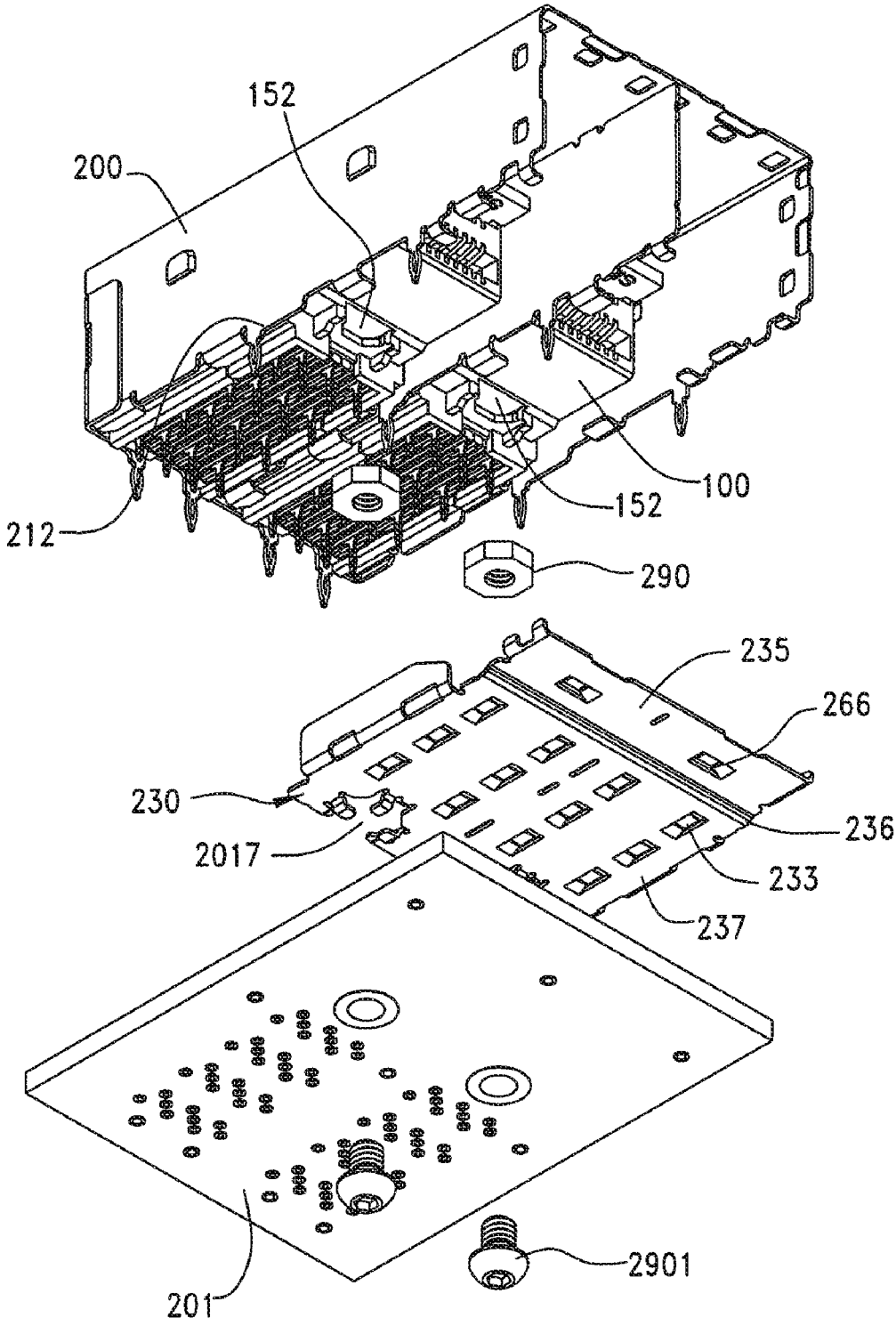
FIG. 15 illustrates a perspective partially exploded view of an embodiment of a ganged connector assembly.
Figure 16:
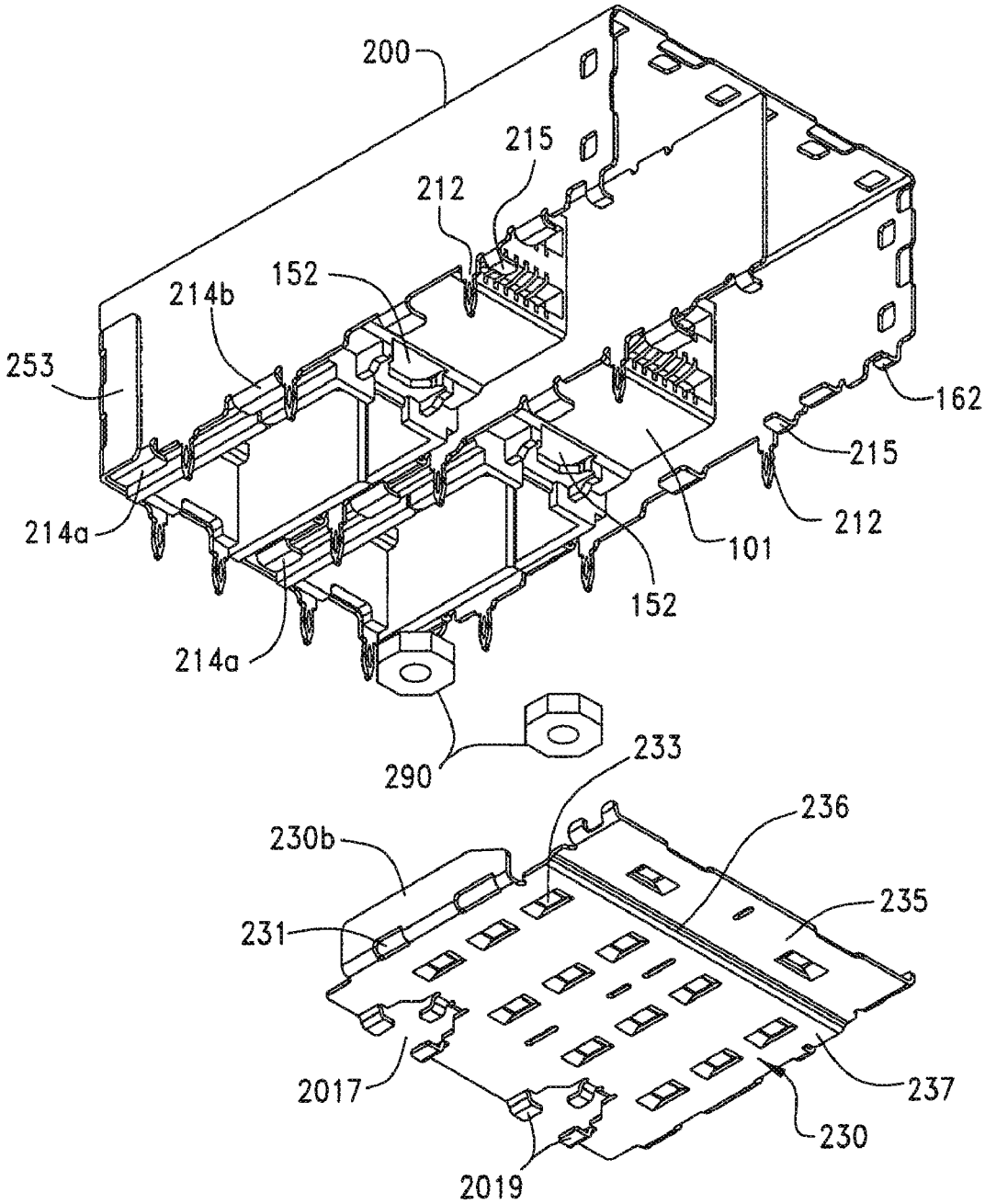
FIG. 16 illustrates a simplified perspective exploded view of the assembly depicted in FIG. 15.
Figure 17:
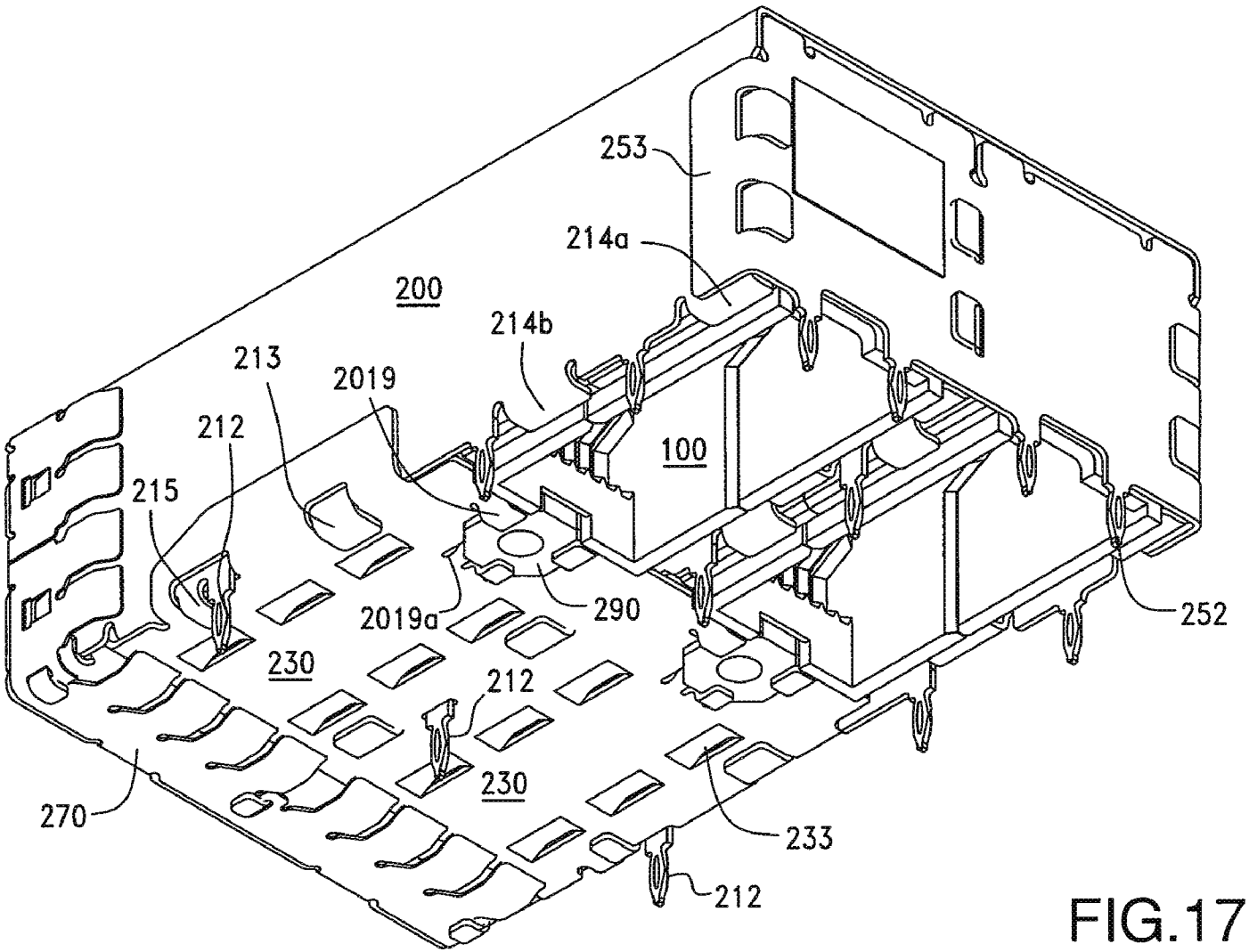
FIG. 17 illustrates a perspective view of the connector assembly depicted in FIG. 15.

FIGS. 12-14 illustrate an embodiment of an assembly that has a shield 205' that provides a ganged receptacle connector (e.g., an array of ports) with distinct openings 206', 206'', 206''', and 206'''' that provide access to four distinct connector-receiving bays. Separating the openings are dividing walls 295, which include first projections 296 that secure the dividing walls 295 to the cover 210' and second projections 297 that secure the dividing walls 295 to the baseplate 230'. The dividing walls 295 may be provided with downwardly extending tail portions 299 in connection of the assembly 2001 to ground circuits on a circuit board. As can be appreciated, therefore, the general construction of the shield 205' may be substantially the same as discussed above with respect to shield 205, with the exception of the inclusion of the dividing walls 295 and the increased width of the cover 210' and the baseplate 230'. It should be noted, however, that the depicted shield construction regarding how the various walls are secured together is not intended to be limiting unless otherwise noted.

As depicted, a fastener 290 with multiple adjacent and contiguous flats 290*a*, 290*b* are used to hold the shield 205 in place upon a circuit board (not shown). In operation, two mating fasteners are coupled together and the coupling helps secure the shield 205 to the circuit board because the engagement arms are positioned between the fastener and the circuit board. As can be appreciated in FIG. 13, the space between the top of the fastener 290 and the bottom of the mating portion 107 of the connector 100 is small, as represented by the distance "t" in FIG. 13. It would be difficult to align the fastener 290 with the shield 205 and the housing after the housing 100 was inserted. Therefore, to help prevent the fastener from coming loose, the retaining notch 300 the fastener 290 on one side while the housing 101 engages the fastener on an opposing side.

As shown in FIGS. 15-20, the assembly may be of a tandem construction with two or more side-by-side connector-receiving bays, with a separate retaining notch 2017 position in each bay (or port) so that each port can be fastened to the circuit board with a fastener 290 in a manner similar to that discussed with respect to the single port configuration.

Figure 18:
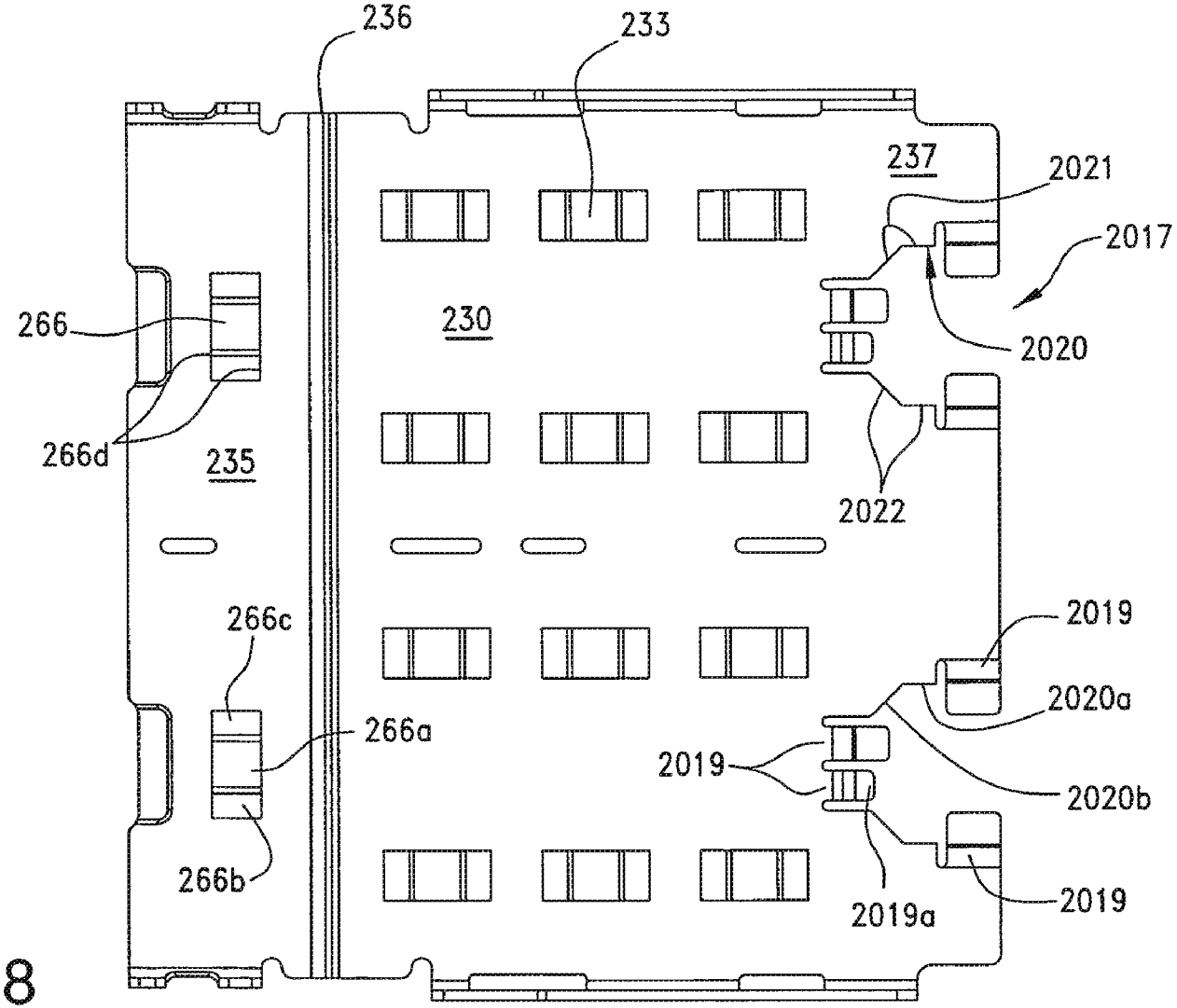
FIG. 18 illustrates a top plan view of an embodiment of a baseplate suitable for use in the connector assembly depicted in FIG. 17.
Figure 19:
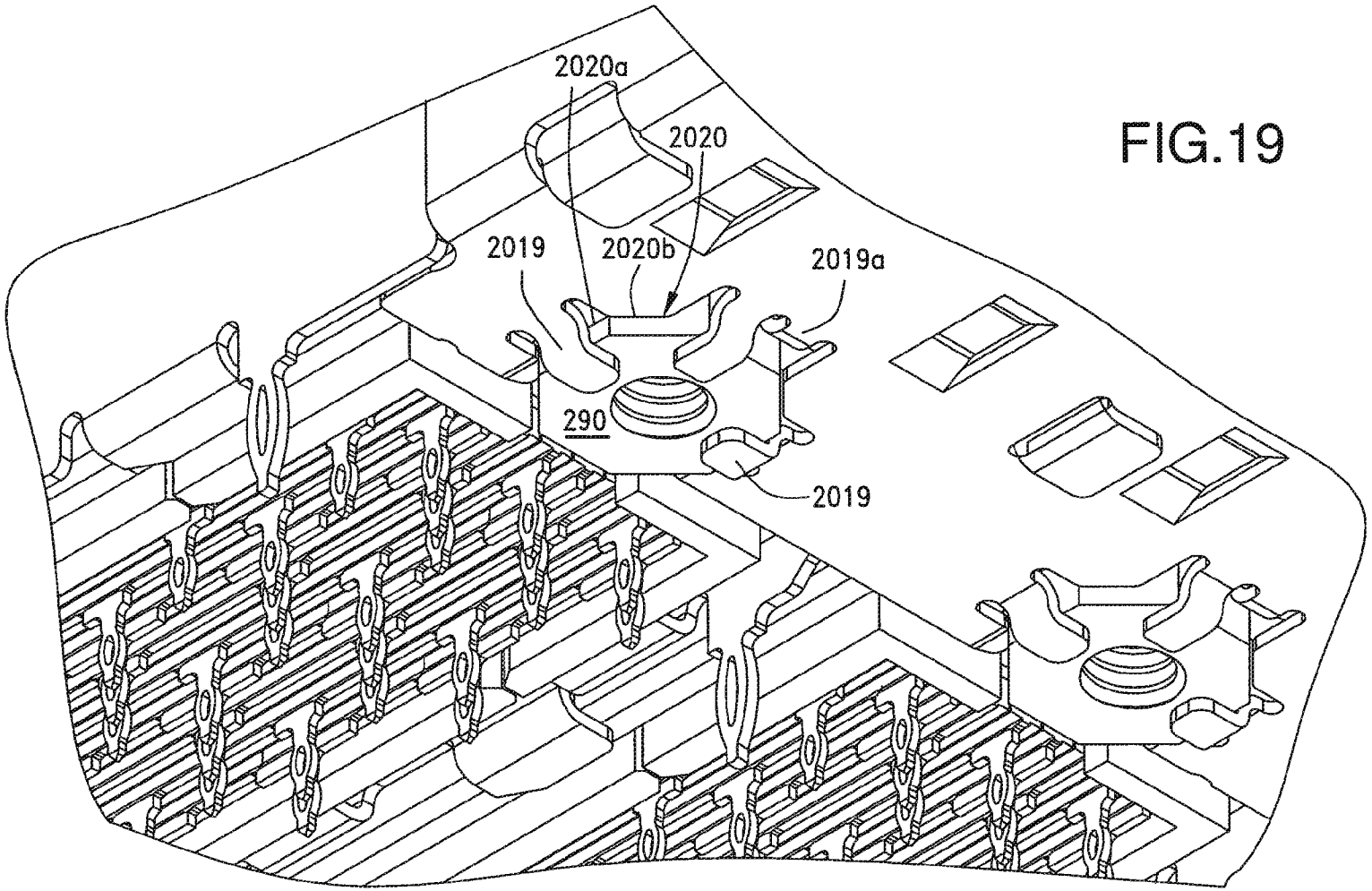
FIG. 19 illustrates a perspective view of a portion of a connector assembly showing a restraining notch.
Figure 20:
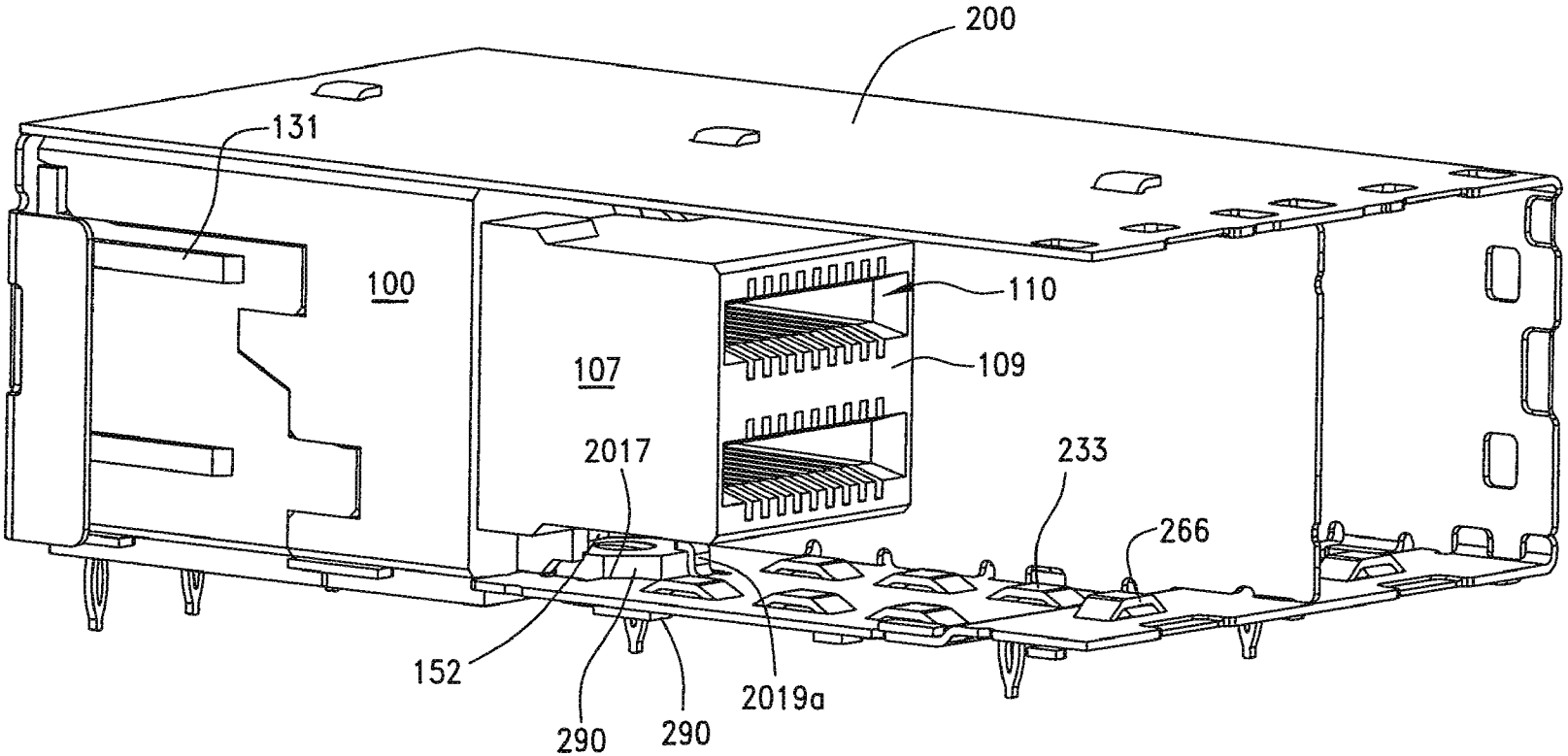
FIG. 20 illustrates a perspective partial view of the connector assembly depicted in FIG. 17, with a sidewall removed for clarity.
Figure 21:
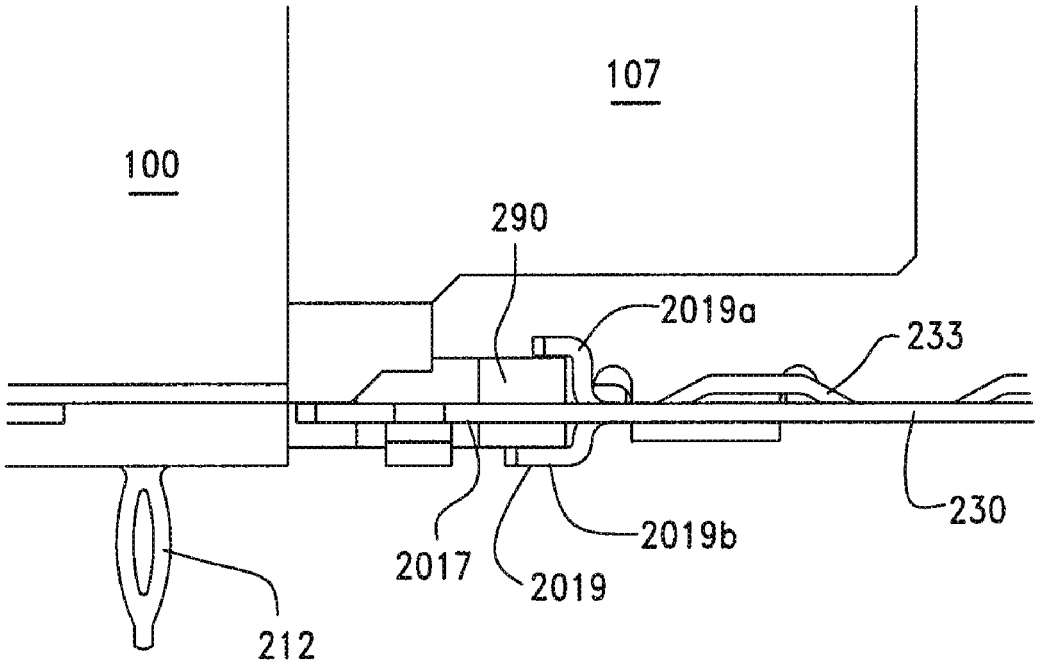
FIG. 21 illustrates an enlarged detail elevational view of FIG. 20.

The shield 200 and particularly the baseplate 230 helps restrain the fastener 290 in place between the connectors 100 and the circuit board. The fastener 290 can be held by the retaining notch 2017 as discussed above. For example, as depicted the notch 2017 is irregular in shape and includes a plurality of angularly disposed surfaces that can engage a corresponding fastener. FIG. 18 is a bottom plan view of the baseplate 230 that illustrates this engagement. For example, the notch 2017 can have two distinct pairs of flat edges 2021, 2012 that define a plurality of stop surfaces 2020 against which the flat sides of the fastener 290 bear when the fastener 290 is positioned in the notch 2017. As depicted, the pairs of flat edges are spaced apart from each other and are separated by an intervening space 2023. The stop surfaces 2020*a*, 2020*b* of each pair are contiguous, meaning they are disposed adjacent each other and are connected to each other at an edge. Thus, the depicted configuration allows for four distinct sides of the fastener 290 to be engaged, although it will be understood that some other number of surfaces may be engaged, depending on the construction of the fastener and the corresponding retaining notch.

The baseplate 230 is depicted with engagement arms 2019 that are configured to support the fastener. These engagement arms 2019 cooperate with the stop surfaces to help restrain the position of the fastener with respect to the baseplate 230 and as depicted, are positioned in half-hexagon like shape to effectively capture the fastener 290 in place. Additionally, because one of the engagement arms is split and has a first portion 2019*a* that is bent above the second bottom wall 237 and restrains the fastener on a first surface opposite a second surface that a second portion 2019*b* of the engagement arm restrains. Thus, the engagement arm 2019 acts in a manner similar to a lock washer. It should be noted that more than one of the engagement arms can be split so that the fastener 290 is supported on two opposing surfaces by two or more engagement arms.

The retaining notch can include a plurality of engagement arms 2019 that are disposed in a space-apart order around the perimeter of the notch 2017. As shown in the embodiment of FIGS. 15-21, three such engagement arms 2019 can be provided, and as shown in FIG. 18, the engagement arms 2019 may be arranged so as to flank each pair of stop surfaces. As can be appreciated, the center engagement arms is split so that it has two portions that extend out of the plane of the baseplate 230 in opposite directions, meaning that one such portion 2019*a* of the engagement arm 2019 extends above the baseplate 230 and fastener 290, which the other portion 2019*b* extends between below the baseplate 230 and fastener 290 so that the engagement arm is engaged on opposite (top and bottom) surfaces of the fastener. In this manner, the fastener is further restrained from unintended movement in a vertical direction.

Figure 10D:
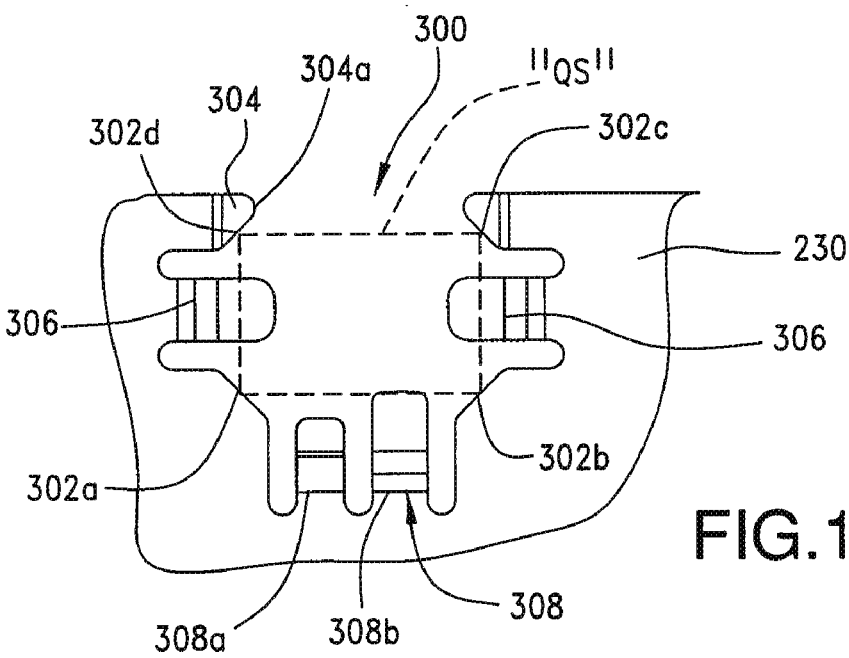
FIG. 10D illustrates an enlarged plan detail view of the retaining notch depicted in of FIG. 10C.
Figure 11:
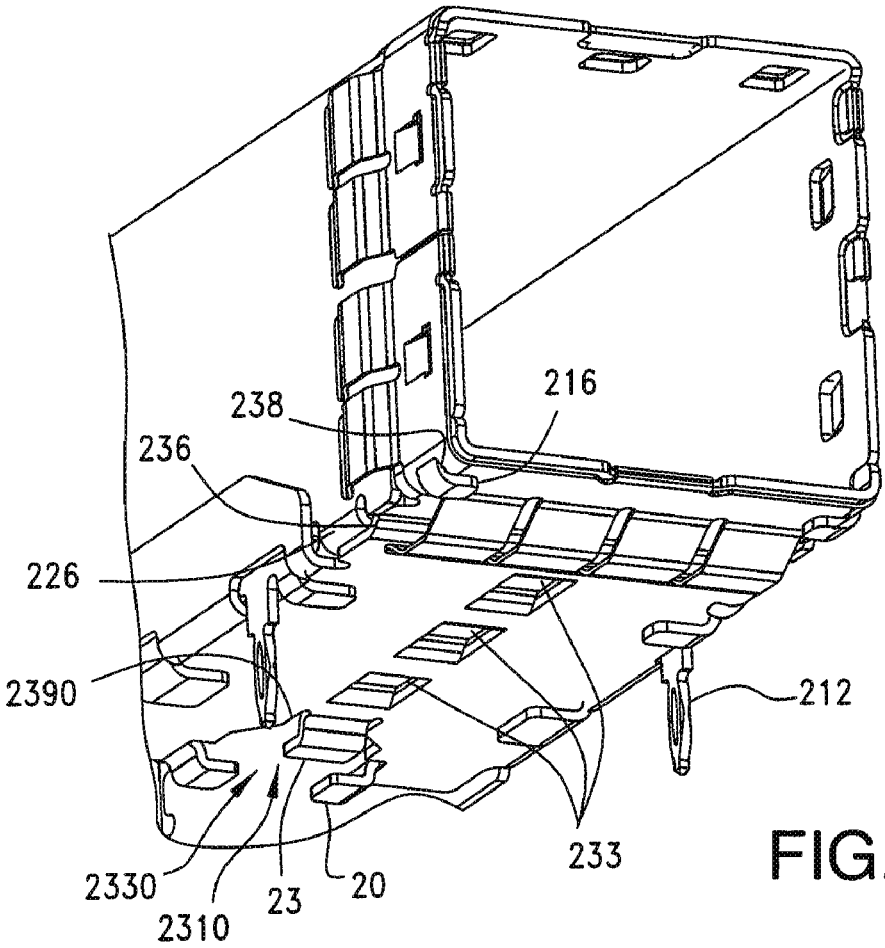
FIG. 11 illustrates a perspective view of the shield depicted in FIG. 5.

FIGS. 10A-D illustrate an embodiment of a shield 200 that includes a baseplate 230 with retaining notch 300 that includes engagement arms 306. The retaining notch 300 includes stop surfaces 302 which in operation act to prevent rotation of a fastener inserted in the retaining notch 300. The engagement arms extend out of a plane defined by a lower wall as well as a plurality of engagement arms that extend out of the plane of the baseplate and into contact with the fastener. FIGS. 10C and 10D illustrate the structure of this embodiment best, showing the baseplate 230 in plan view with a fastener engaging opening, or notch, 300 formed therein along the trailing edge of the baseplate. The opening 300 has a plurality of stop surfaces 302, with four such stop surfaces 302*a-d* being shown. The stop surfaces 302 are arranged in pairs of confronting surfaces, meaning that one such pair includes surfaces 302*a*, 302*c* and the other such pair includes surfaces 302*b*, 302*d*. The stop surfaces 302 are further preferably arranged in so that they lie at corners of an imaginary four-sided figure "QS" that is drawn in phantom in the notch in FIG. 10D. It should be noted that while the depicted retaining notch 300 depicts stop surfaces separately from engagement arms, in an embodiment the engagement arm may also include a stop surface. For example, the engagement arm may be wide enough to engage a side of the fastener. However, if it is desirable to engage a corner of the fastener with two adjacent stop edges it often will be easier to form such stop edges directly from the baseplate.

In any event, as depicted four sides of the fastener are engaged by the baseplate stop surfaces and unintended movement of the fastener in the horizontal direction (as well as rotational movement) is prevented. In other words, the confronting stop surfaces can be seen to "trap" the fastener in place in the notch 300 to hold it in place horizontally so that is cannot move forwardly or backwardly. The rearmost stop surfaces 302*c*, 302*d* may be formed on thin leg, or arm portions 304 that extend toward each other proximate the rear of the notch 300. The ends 304*a* of these leg portions 304 extend toward a centerline of the notch and may be slightly bent out of plane with the baseplate 230, preferably upwardly.

The baseplate 230 also includes a plurality of engagement arms 306, 308 that are disposed proximate the notch 300 and which extend out of plane of the baseplate and above and below the second bottom wall provided by the baseplate 230. The engagement arms 306, 308 are disposed around the notch perimeter in a spaced apart fashion, and they occupy the intervening spaces that separate the stop surfaces from each other. The engagement arms 306 are formed as individual arms that face each other, while the center arms 308 include a pair of closely spaced engagement arms that extend out of plane of the baseplate 230 and away from each other in opposite directions, one above the fastener and one below it. This provides engagement to the top and bottom surfaces of the fastener 290. In this manner the control of unintended vertical movement is controlled. Although the two engagement arms 306 are shown as extending in one common direction, below the plane of the baseplate 230, it will be understood that they can extend both above the plane of the baseplate or above and below as with the engagement arms 308. The center engagement arms 308 may also be alternatively formed as a split engagement arm with two extending portions.

FIG. 22 illustrates an alternative embodiment of a fastener 290'. As can be appreciated, the fastener 290' could be used in place of the fastener 290 and the difference would be that the screw threads would extend from a fastener positioned inside the shield. Otherwise, the retaining notch would function similarly to what was described above. It should also be noted that while a hexagon shaped fastener is disclosed, any other desirable shape, such as but not limited to a rectangular shape, could be used. It should further be noted that while corners are beneficial in the fastener, they are not required. Shapes such as an oblong shape can also be used in combination with appropriately shaped stop surfaces.

It will be understood that there are numerous modifications of the illustrated embodiments described above which will be readily apparent to one skilled in the art, such as many variations and modifications of the compression connector assembly and/or its components including combinations of features disclosed herein that are individually disclosed or claimed herein, explicitly including additional combinations of such features, or alternatively other types of contact array connectors. Also, there are many possible variations in the materials and configurations. These modifications and/or combinations fall within the scope of the disclosure. Accordingly, the claims are not intended to be limited to the depicted combination of features unless otherwise noted. It is noted, as is conventional, the use of a singular element in a claim is intended to cover one or more of such an element.

What is claimed is:

1. A connector assembly, comprising:

a housing with a mating face that includes two horizontal card-receiving slots that are offset by a first distance;

a plurality of wafers that each support four terminals; each of the four terminals having a contact positioned on one side of one of the two card receiving slots, the terminals on one side of at least one of the two slots being arranged in a ground, signal, signal pattern;

a shield providing an enclosure in which the housing is positioned, the shield having a opening configured to receive a mating connector that mates with the two card-receiving slots, the opening having a height and a width, the height and width each being not more than three times the first distance, wherein the connector is configure to provide not more than three (3) percent crosstalk with a signal frequency of at least 4.5 GHz.

2. The connector of claim 1, wherein the first distance is about 4 mm.

3. The connector of claim 2, wherein the signal frequency is at least 7.5 GHz.

4. The connector of claims 3, wherein the connector is configured to provide not more than two (2) percent crosstalk.

* * * * *